US012173903B1

(12) United States Patent
Van Thomme

(10) Patent No.: US 12,173,903 B1
(45) Date of Patent: Dec. 24, 2024

(54) FIREPIT RADIANT AND CONVECTIVE ENERGY GUIDANCE DEVICE

(71) Applicant: Nathan Todd Van Thomme, Ankeny, IA (US)

(72) Inventor: Nathan Todd Van Thomme, Ankeny, IA (US)

(73) Assignee: HeatHalo, LLC, Ankeny, IA (US)

( * ) Notice: Subject to any disclaimer, the term of this patent is extended or adjusted under 35 U.S.C. 154(b) by 0 days.

(21) Appl. No.: 18/739,276

(22) Filed: Jun. 10, 2024

Related U.S. Application Data

(60) Provisional application No. 63/472,204, filed on Jun. 9, 2023.

(51) Int. Cl.
*F24B 1/189* (2006.01)
*F24B 1/19* (2006.01)
*F24B 1/195* (2006.01)

(52) U.S. Cl.
CPC ..... *F24B 1/189* (2013.01); *F24B 1/19* (2013.01); *F24B 1/1957* (2013.01)

(58) Field of Classification Search
CPC ..... F24B 1/189; F24B 1/19; F24B 1/1957; F24B 5/02; F24B 1/192
See application file for complete search history.

(56) References Cited

U.S. PATENT DOCUMENTS 11,885,500 B1 * 1/2024 Ressler ..... F24B 3/00
2014/0311356 A1 * 10/2014 Daniels ..... A47J 37/0713 99/340
2021/0018180 A1 * 1/2021 Jan ..... F24B 1/192
2021/0048188 A1 * 2/2021 Harrington ..... F24B 5/026
2021/0404663 A1 * 12/2021 Strange ..... F24B 1/182
2022/0364732 A1 * 11/2022 Ressler ..... F24B 1/192
2023/0151967 A1 * 5/2023 Weilert ..... F24B 3/00 126/59

OTHER PUBLICATIONS

Solo Stove, "Solo Stove LIVE—Heat Deflector Demo", available from: https://www.youtube.com/watch? v=KSGx00NW1ZY , last accessed on Aug. 7, 2024 and originally posted (according to the date on the site currently showing the video) on Jan. 21, 2022.
Break It Yourself, "Breeo Heat Deflector Review I Just Buy It", available from: https://youtu.be/rEG2JE0wTcE? si=fWC33xByl4z33LNK , last accessed on Aug. 3, 2024 originally posted (according to the date on the site currently showing the video) on Feb. 3, 2023.

* cited by examiner

*Primary Examiner* — Alfred Basichas
(74) *Attorney, Agent, or Firm* — Nyemaster Goode P.C.

(57) ABSTRACT

An energy guidance/heat deflecting device for redirecting convective and radiant energy leaving from an interior volume of a smokeless fire pit out an open top of the smokeless fire pit. The energy guidance/heat deflecting device typically includes: a circular, planar bottom support; at least three upwardly extending supports each spaced from one another and spaced about the exterior perimeter portion of the circular, planar bottom support and proximate the exterior perimeter edge of the circular, planar bottom support; and a downwardly facing truncated cone shaped energy deflecting material.

20 Claims, 39 Drawing Sheets

FIREPIT RADIANT AND CONVECTIVE ENERGY GUIDANCE DEVICE

CROSS-REFERENCE TO RELATED APPLICATION

This application claims priority to and the benefit of Provisional U.S. Patent Ser. No. 63/472,204 filed on Jun. 9, 2023, entitled "Smokeless Firepit Radiant and Convective Energy Guidance Device", the entire disclosure of which is hereby incorporated by reference.

BACKGROUND

A smokeless firepit is designed to reduce or eliminate the amount of smoke produced during the combustion of wood or other fuel sources placed within the smokeless fire pit. The construction and design of a smokeless firepit are based on the principles of combustion and airflow.

As shown in FIG. 1, a smokeless firepit typically consists of a double-wall structure, with an inner wall 12 and an outer wall 14. The fire pit base 22 typically extends and covers the entirety of the bottom within the inner wall 12 and receives wood or other combustible material to be burned as fuel for the fire within the firepit. There is also typically an elevated interior wood or other fuel receiving floor that sits above the base that is removeable and engages an interior shelf proximate the bottom of the interior wall so that the interior wood or other fuel receiving floor sits above the fire pit base 22. The space between the walls serves as a natural air flow system that helps to promote complete combustion and reduce the amount of smoke produced by providing heated air out the hot air outlets 20 on the interior of the smokeless fire pit, which further combust the ash/smoke before it departs the smokeless fire pit. The hot air traveling out of the hot air outlets 20 rises but is generally directed inward toward the center of the smokeless fire pit to help reduce the amount of smoke by delivering thermal energy inwardly to burn ash/smoke traveling upward and out of the fire pit. The fire is built within the interior volume defined by the inner wall 12, the fire pit base 22, and the plane defined by the perimeter rim 16. The outer wall 14 is designed to capture and direct air into the fire pit through air inlets 18 dispersed around the outer wall 16 proximate the base of the overall smokeless fire pit 10. The air flows up within the space between the inner wall 12 and the outer wall 14 as it is heated as it traverses upward and then is directed inward through hot air outlets 20 around the perimeter of the inner wall 12 proximate the top of the smokeless fire pit 10. This airflow provides oxygen to the fire and promotes a clean, hot burn thereby limiting smoke transmitted out the top of the smokeless fire pit. It is important to note that even though these type of fire pits are named "smokeless" they do not necessarily remove all smoke from being released from the fire pit. However, the amount of smoke is reduced due to the redirection of additional thermal energy inward to burn the ash/smoke.

The design of a smokeless firepit must be designed with a proper airflow system that can regulate the amount of air entering and exiting the fire pit. This is typically achieved through the series of vents or inlets 18 placed around the bottom of the fire pit, which can be optionally adjusted via dampers or size restriction mechanical covers to control the flow of air.

One feature of a smokeless firepit is its ability to maintain a high temperature during the combustion process, which facilitates the airflow pattern and the top inward directional airflow used to reduce the smoke at the top of the fire pit. This is typically achieved through the use of specialized materials, such as refractory ceramics or high-temperature steel, that can withstand the intense heat generated by the fire. These materials also help to retain heat within the firepit, allowing for a longer, more sustained burn. However, the material used to construct a smokeless fire pit is not limited to specific materials necessarily, but the material must be able to withstand the high temperatures of a smokeless fire pit, typically temperatures up to about 1000° F.

Typically, the fuel source used in a smokeless firepit is natural wood for the ambience of the fire, but other fuel sources such as natural gas or propane, which burn much cleaner than traditional wood fires may be used as well.

Despite all of its very desirable features, one of the significant drawbacks and issues that arises when using a smokeless fire pit is that the heat generated by the fire is intentionally designed to be transmitted inwardly to burn ash/reduced smoke. This results in the heat energy moving upward out of the open top of the firepit in a generally cylindrical column upward without much radiant or convective heat energy transmitted laterally proximate the top of the firepit and progressively less and less below that plane. The energy is not transmitted laterally as effectively as it would with a traditional fire pit. This is because the double-wall construction and airflow system of a smokeless fire pit are designed to promote efficient combustion and reduce smoke by transmitting heat toward the center of the fire pit at the top of the fire pit as discussed above, rather than to distribute heat evenly and laterally outward. As discussed above, the heat energy is driven inwardly by the airflow pathway because of the of a smokeless fire pit.

In a traditional fire pit, heat is often transmitted laterally through the surrounding air and radiated outwards, creating a warm and cozy atmosphere for people gathered around the fire. However, in a smokeless fire pit, the airflow system can create a more focused, upward draft that directs the heat and flames upwards towards the sky, rather than outwards towards the surrounding area where people may be seated. This results in less comforting heat transferring to the people seated around the smokeless fire pit.

While this focused airflow can be great for reducing or eliminating smoke and providing a cleaner burn, it can also result in a less comfortable and less social atmosphere for those gathered around the fire. A past attempt to mitigate this significant drawback to the experience of using a smokeless firepit involves placing an elevated covering heat deflector 24 over the entire heat column extending outward from the fire pit as shown in FIG. 1. The elevated covering heat deflector 24 is elevated by placing detachable, elevating legs 28 into slots in the bottom of the concave center disk 26 and positioning the bottom of the legs on the smokeless firepit shelf 32. The center portion of the concave center disk may have a ring of disk apertures 30 to allow some of the heat to continue to traverse upward while the concave center disk blocks the heat to direct heat outward. The detachable legs are typically at least about 7-8 inches long even for the smallest diameter fire pits and the outermost edge of the concave center disk extends beyond the outer wall 14 of the fire pit, typically by at least one inch and up to about 3 inches beyond the outer wall. Unfortunately, this design has many drawbacks. Most significantly, the elevated covering heat deflector covers the fire completely blocking the ambiance and viewing of the fire. It also makes it more difficult to add additional combustible material to the inside of the fire pit. This system is elevated higher in order to allow addition of combustible material from the sides, but this drastically limits the amount of heat energy deflected. This design also is only design to redirect convective heat and not both radiant and convective energy laterally in a significant amount. Finally, since the design extends at least about 3 inches beyond the outer dimensions of the fire pit itself, one walking by or close to the fire pit may accidentally hit the top of the heat deflector and dislodge it from engagement with the top surface of the fire pit.

SUMMARY

An aspect of the present disclosure is generally directed to an energy guidance/heat deflecting device for redirecting convective and radiant energy leaving from an interior volume of a smokeless fire pit out an open top of the smokeless fire pit. The energy guidance/heat deflecting device typically includes: a circular, planar bottom support having an exterior perimeter edge, an interior circular aperture defined by a bottom support interior circular aperture perimeter edge, a smokeless fire pit facing side, an exterior perimeter portion proximate the exterior perimeter edge, and an upward facing side; at least three upwardly extending supports each spaced from one another and spaced about the exterior perimeter portion of the circular, planar bottom support and proximate the exterior perimeter edge of the circular, planar bottom support and where the at least three upwardly extending supports each have a bottom support engaging end portion and an opposite end portion, which is a downwardly facing truncated cone shaped energy deflecting material engaging end portion; and a downwardly facing truncated cone shaped energy deflecting material having smokeless fire pit facing surface, an upwardly facing surface, and a downwardly facing aperture defined by a perimeter edge of a first end of the downwardly facing truncated cone shaped energy deflecting material and an upwardly facing perimeter, where a diameter of the downwardly facing aperture is smaller than the diameter of the upwardly facing perimeter, and where the upwardly facing perimeter of the downwardly facing truncated cone shaped energy deflecting material engages the downwardly facing truncated cone shaped energy deflecting material engaging end portion of each of the at least three upwardly extending supports such that the downwardly facing aperture is spaced above the interior circular aperture defined by the bottom support interior circular aperture perimeter edge. The diameter of the interior circular aperture defined by the bottom support interior circular aperture perimeter edge is larger than the diameter of the downwardly facing aperture of the downwardly facing truncated cone shaped energy deflecting material such that convective and radiant heat energy leaving the smokeless fire pit will contact a portion of the smokeless fire pit facing surface and be directed outwardly and sideways away from the fire pit when the fire pit is in use and the energy guidance/heat deflecting device is engaged with the top of the smokeless fire pit.

Yet another aspect of the present disclosure is generally directed toward an energy guidance/heat deflecting device for redirecting convective and radiant energy leaving from an interior volume of a smokeless fire pit out the open top of the smokeless fire pit. The energy guidance/heat deflecting device typically includes: a circular, planar bottom support having an exterior perimeter edge, an interior circular aperture defined by a bottom support interior circular aperture perimeter edge, a smokeless fire pit facing side, an exterior perimeter portion proximate the exterior perimeter edge, and an upward facing side; at least three upwardly extending supports each spaced from one another and spaced about the exterior perimeter portion of the circular, planar bottom support and proximate the exterior perimeter edge of the circular, planar bottom support and where the at least three upwardly extending supports each have a bottom support engaging end portion and an opposite end portion, which is a downwardly facing truncated cone shaped energy deflecting material engaging end portion; and a downwardly facing truncated cone shaped energy deflecting material having smokeless fire pit facing surface, an upwardly facing surface, and a downwardly facing aperture defined by a perimeter edge of a first end of the downwardly facing truncated cone shaped energy deflecting material and an upwardly facing perimeter, where a diameter of the downwardly facing aperture is smaller than the diameter of the upwardly facing perimeter, and where the upwardly facing perimeter of the downwardly facing truncated cone shaped energy deflecting material engages the downwardly facing truncated cone shaped energy deflecting material engaging end portion of each of the at least three upwardly extending supports such that the downwardly facing aperture is spaced above the interior circular aperture defined by the bottom support interior circular aperture perimeter edge. The diameter of the interior circular aperture defined by the bottom support interior circular aperture perimeter edge is typically larger than the diameter of the downwardly facing aperture of the downwardly facing truncated cone shaped energy deflecting material such that convective and radiant heat energy leaving the smokeless fire pit will contact a portion of the smokeless fire pit facing surface and be directed outwardly and sideways away from the fire pit when the fire pit is in use and the energy guidance/heat deflecting device is engaged with the top of the smokeless fire pit. The energy guidance/heat deflecting device further may include a flat top ring that has a flat top ring center aperture defined by a flat top ring interior edge and a flat top ring center aperture diameter and where the flat top ring is engaged to each of the at least three upwardly extending supports at the downwardly facing truncated cone shaped energy deflecting material engaging end portion but above where the downwardly facing truncated cone shaped energy deflecting material is engaged to the downwardly facing truncated cone shaped energy deflecting material engaging end portion engaging end portion. The circular, planar bottom support and the downwardly facing truncated cone shaped energy deflecting material are each fixed to the at least three upwardly extending supports by a weld; the downwardly facing aperture is concentrically aligned above the interior circular aperture defined by the bottom support interior circular aperture perimeter edge. Each of the circular, planar bottom support, the at least three upwardly extending supports, and the downwardly facing truncated cone shaped energy deflecting material may be constructed from 16 gauge polished stainless steel.

Yet another aspect of the present disclosure is generally directed toward an energy guidance/heat deflecting device for redirecting convective and radiant energy leaving from an interior volume of a smokeless fire pit out the open top of the smokeless fire pit. The energy guidance/heat deflecting device typically includes: a circular, planar bottom support having an exterior perimeter edge, an interior circular aperture defined by a bottom support interior circular aperture perimeter edge, a smokeless fire pit facing side, an exterior perimeter portion proximate the exterior perimeter edge, and an upward facing side; at least three upwardly extending supports each spaced from one another and spaced about the exterior perimeter portion of the circular, planar bottom support and proximate the exterior perimeter edge of the circular, planar bottom support and where the at least three upwardly extending supports each have a bottom support engaging end portion and an opposite end portion, which is a downwardly facing truncated cone shaped energy deflecting material engaging end portion; and a downwardly facing truncated cone shaped energy deflecting material having smokeless fire pit facing surface, an upwardly facing surface, and a downwardly facing aperture defined by a perimeter edge of a first end of the downwardly facing truncated cone shaped energy deflecting material and an upwardly facing perimeter, where a diameter of the downwardly facing aperture is smaller than the diameter of the upwardly facing perimeter, and where the upwardly facing perimeter of the downwardly facing truncated cone shaped energy deflecting material engages the downwardly facing truncated cone shaped energy deflecting material engaging end portion of each of the at least three upwardly extending supports such that the downwardly facing aperture is spaced above the interior circular aperture defined by the bottom support interior circular aperture perimeter edge. The diameter of the interior circular aperture defined by the bottom support interior circular aperture perimeter edge is larger than the diameter of the downwardly facing aperture of the downwardly facing truncated cone shaped energy deflecting material such that convective and radiant heat energy leaving the smokeless fire pit will contact a portion of the smokeless fire pit facing surface and be directed outwardly and sideways away from the fire pit when the fire pit is in use and the energy guidance/heat deflecting device is engaged with the top of the smokeless fire pit. The circular, planar bottom support and the downwardly facing truncated cone shaped energy deflecting material are each typically fixed to the at least three upwardly extending supports by a weld. The downwardly facing aperture is concentrically aligned above the interior circular aperture defined by the bottom support interior circular aperture perimeter edge. The flat top ring center aperture diameter is within one inch of the diameter of the diameter of the upwardly facing perimeter of the downwardly facing truncated cone shaped energy deflecting material. Each of the circular, planar bottom support, the at least three upwardly extending supports, and the downwardly facing truncated cone shaped energy deflecting material are 16 gauge polished stainless steel.

Another aspect of the present disclosure is generally directed to a method of deflecting heat energy leaving an interior volume of a smokeless fire pit comprising the steps of: starting a fire within the interior volume of a smokeless fire pit having a top perimeter rim with a plurality of hot air outlets on the interior surface of the smokeless fire pit proximate the top perimeter rim and air inlets proximate a bottom of the smokeless fire pit, where air comes into the smokeless fire pit through the air inlets travels within the base of the smokeless fire pit and upward through a channel within a channel in a side wall of the smokeless fire pit and thereafter out the hot air outlets to burn the ash and smoke leaving the interior volume of the smokeless fire pit; and placing a heat deflector onto a top perimeter rim of a smokeless fire pit. The heat deflector typically includes: a circular, planar bottom support having an exterior perimeter edge, an interior circular aperture defined by a bottom support interior circular aperture perimeter edge, a smokeless fire pit facing side, an exterior perimeter portion proximate the exterior perimeter edge, and an upward facing side; at least three upwardly extending supports each spaced from one another and spaced about the exterior perimeter portion of the circular, planar bottom support and proximate the exterior perimeter edge of the circular, planar bottom support and where the at least three upwardly extending supports each have a bottom support engaging end portion and an opposite end portion, which is a downwardly facing truncated cone shaped energy deflecting material engaging end portion; and a downwardly facing truncated cone shaped energy deflecting material having smokeless fire pit facing surface, an upwardly facing surface, and a downwardly facing aperture defined by a perimeter edge of a first end of the downwardly facing truncated cone shaped energy deflecting material and an upwardly facing perimeter, where a diameter of the downwardly facing aperture is smaller than the diameter of the upwardly facing perimeter, and where the upwardly facing perimeter of the downwardly facing truncated cone shaped energy deflecting material engages the downwardly facing truncated cone shaped energy deflecting material engaging end portion of each of the at least three upwardly extending supports such that the downwardly facing aperture is spaced above the interior circular aperture defined by the bottom support interior circular aperture perimeter edge. The diameter of the interior circular aperture defined by the bottom support interior circular aperture perimeter edge is typically larger than the diameter of the downwardly facing aperture of the downwardly facing truncated cone shaped energy deflecting material such that convective and radiant heat energy leaving the smokeless fire pit will contact a portion of the smokeless fire pit facing surface and be directed outwardly and sideways away from the fire pit when the fire pit is in use and the energy guidance/heat deflecting device is engaged with the top of the smokeless fire pit. The hot air leaving the hot air outlets of the smokeless fire pit travels further into the center of the interior volume of the smokeless fire pit by the smokeless fire pit facing side of the circular, planar bottom support thereby enhancing the effectiveness of the hot air at burning the ash or smoke of the smokeless fire pit by focusing the hot air into a smaller volume before it can rise through the heat deflector on the top of the smokeless fire pit. The method further typically includes the step of channeling the heat energy leaving from the interior of the smokeless fire pit and outward laterally from the side of the heat deflector.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. In addition, drawings are not necessarily to scale. Certain features of the invention may be exaggerated in scale or shown in schematic form in the interest of clarity and conciseness.

DETAILED DESCRIPTION

Before subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting in any manner. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

Figure 2:
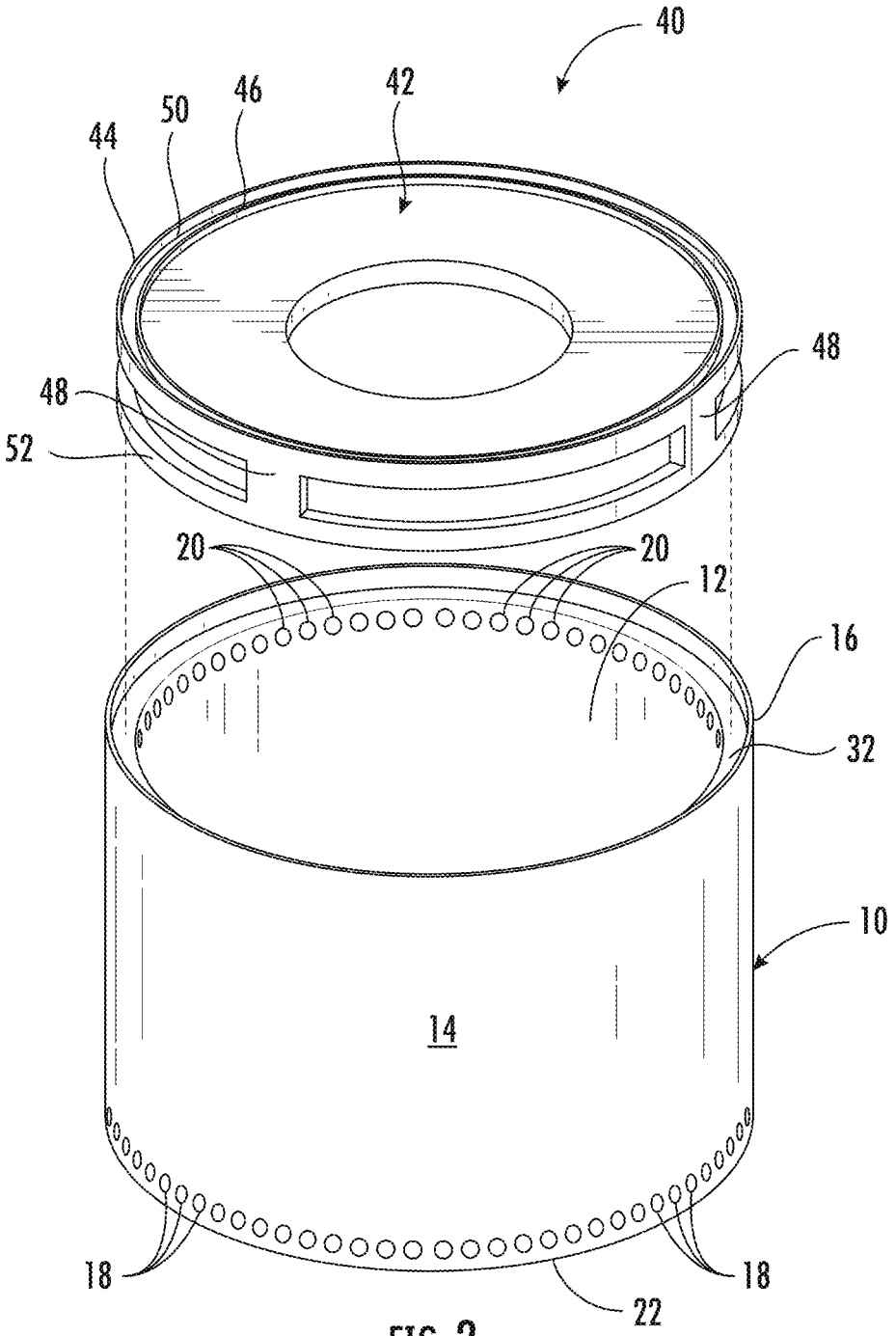
FIG. 2 is an exploded, front perspective view of an energy guidance device showing how the energy guidance device may be engaged to the top of a smokeless fire pit according to an aspect of the present disclosure.
Figure 3:
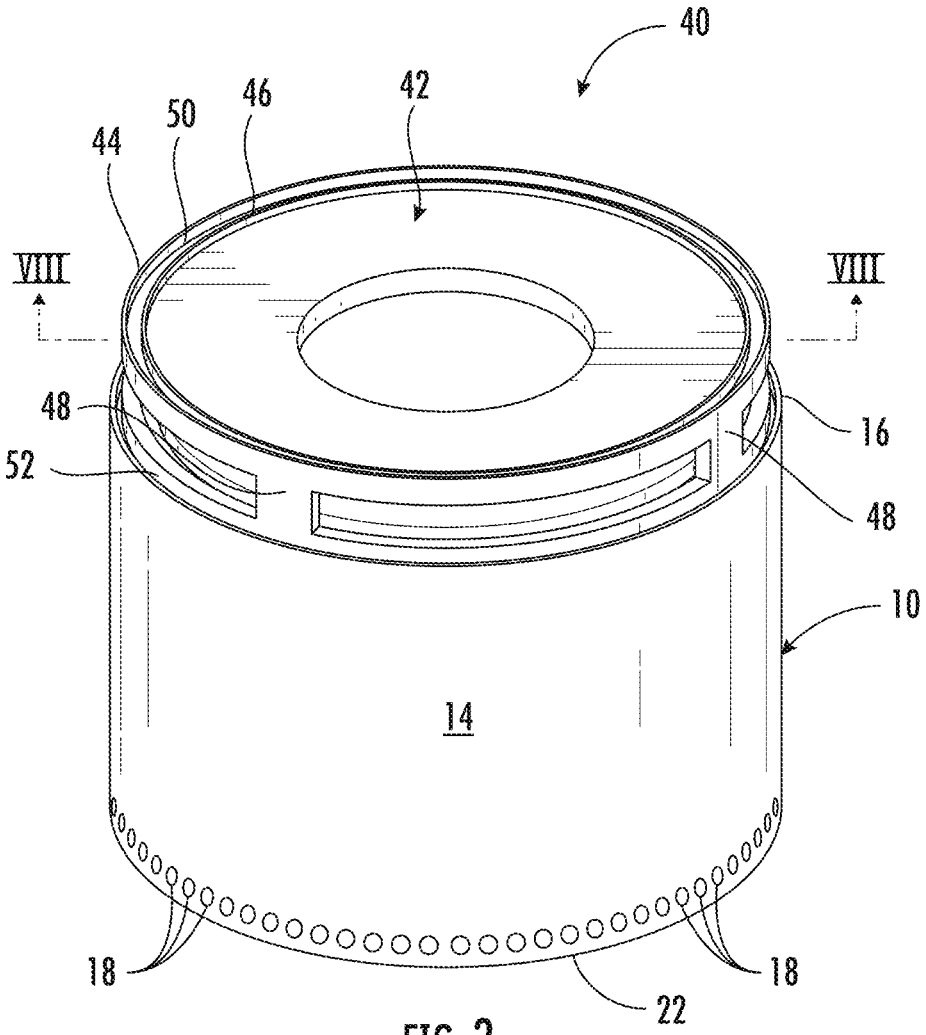
FIG. 3 is a front perspective view of an energy guidance device engaged with the top portion of a round smokeless fire pit according to an aspect of the present disclosure.
Figure 4:
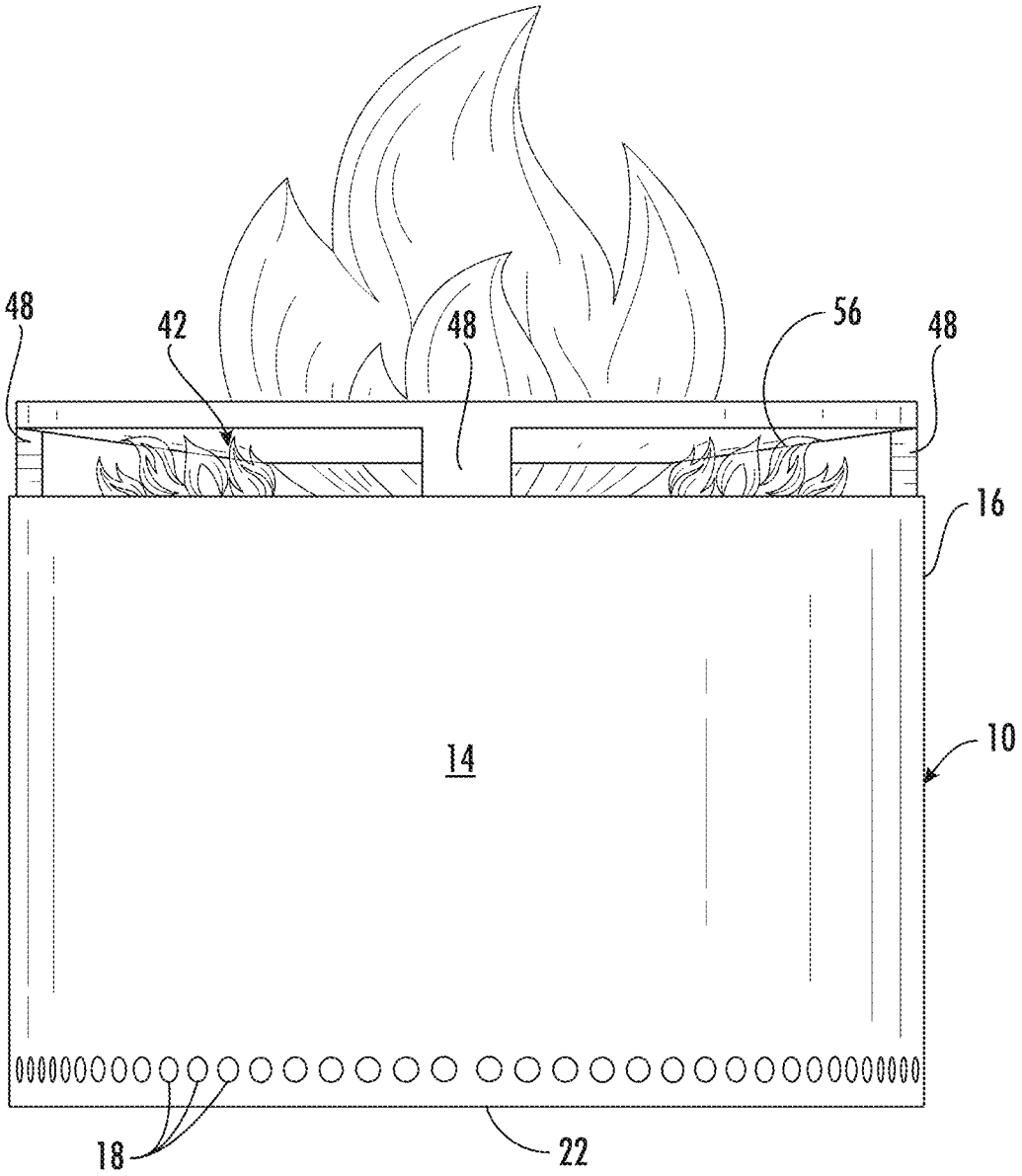
FIG. 4 is front view of the energy guidance device according to an aspect of the present disclosure showing how flames are allowed to project above and through the center of the energy guidance device while also deflecting energy laterally proximate the top of the smokeless fire pit.

FIG. 2 shows an energy guidance device 40 according to an aspect of the present disclosure and how it is designed to engage the perimeter rim 16 of a SOLO STOVE® brand smokeless fire pit. Of course, an energy guidance device of any of those described an shown herein may be employed and used in connection with any type or brand of smokeless fire pit or even potentially a traditional fire pit, but would not typically be used with a traditional fire pit because they do not typically exhibit the same problems of a lack of lateral energy transmission as discussed above.

The energy guidance devices of the present disclosure may have a hallow channel receiving channel column engaged to the perimeter edge of the energy guidance device of the present disclosure to receive a suspension rod of the BREEO® brand smokeless fire pit or the energy guidance devices of the present disclosure or may simply be set on top of or clamped into a releasably secure engagement using a spring clamp or releasable C-Clamp or other clamp or screw.

The energy guidance devices of the present disclosure are designed to redirect at least convective energy, but ideally both convective and radiant energy from the energy leaving a smokeless fire pit without altering the smokeless design aspects of the smokeless fire pit. The energy guidance devices maintain the smokeless design features while providing the lateral energy aspects of a more traditional fire pit to create an improved overall user experience providing the best features of both types of fire pits. The energy guidance devices of the present disclosure typically have entirely open center portions or at least 85% of the center portion define by an interior perimeter. This open center allows for easy addition of combustible materials into the smokeless fire pit and the fire to appear similar to a traditional fire pit. The devices of the present disclosure allow for those enjoying the fire pit, typically a smokeless fire pit, to not only feel more energy redirected at them, particularly when they are seated around the smokeless fire pit, but also enjoy the ability to visually see the flames from the smokeless fire pit.

Figure 9A:
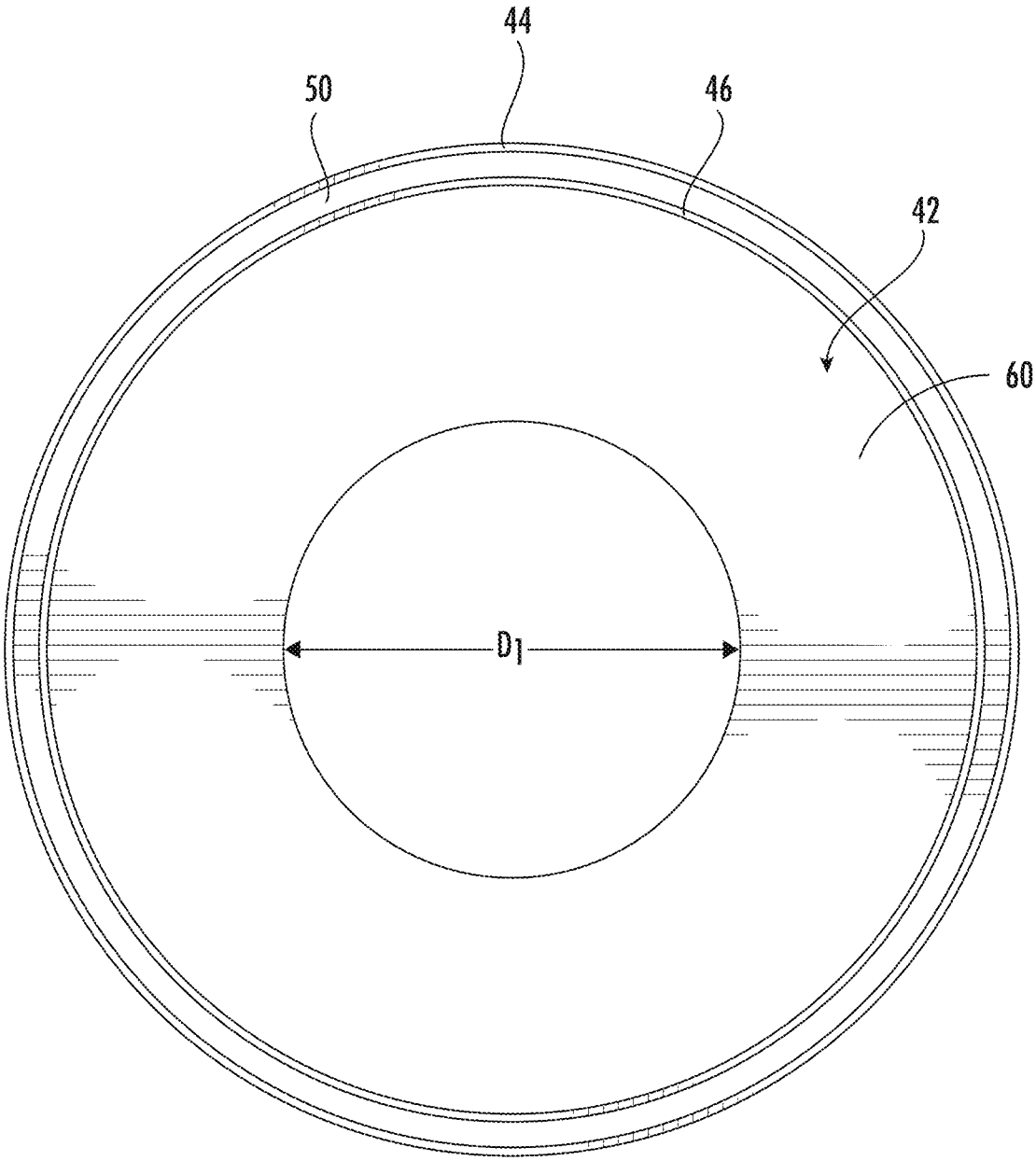
FIG. 9A is a top view of an energy guidance device according to an aspect of the present disclosure.
Figure 17:
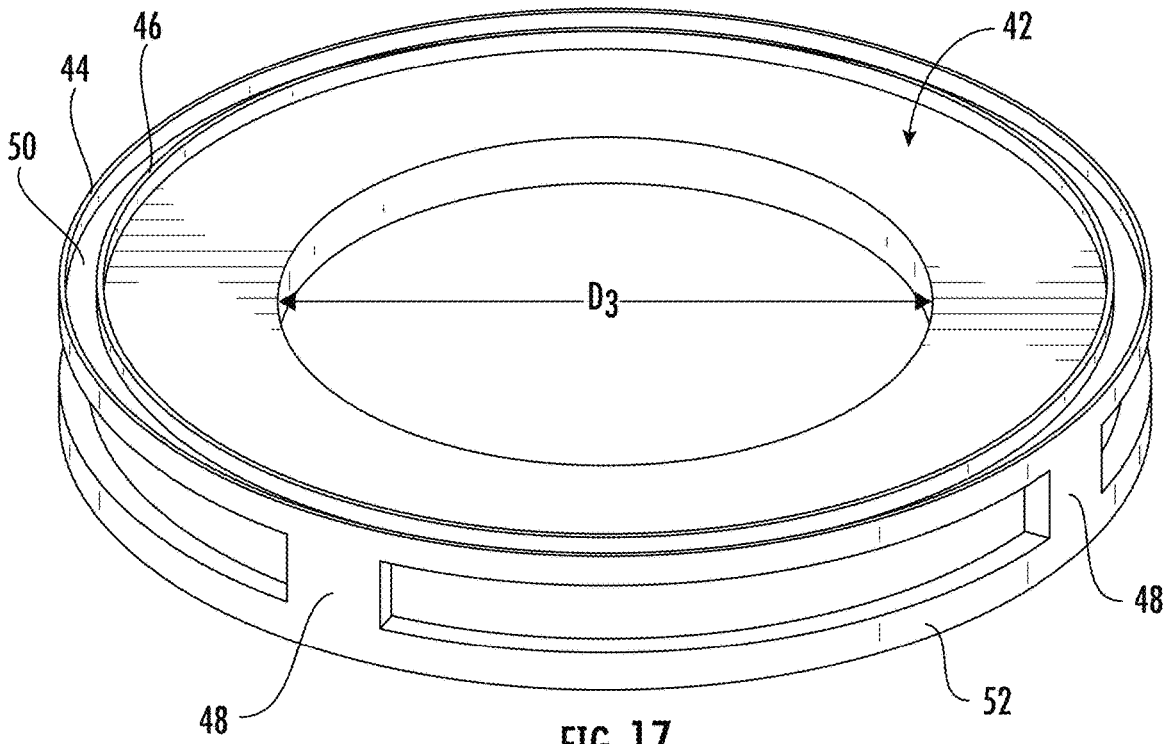
FIG. 17 is top front perspective view of an energy guidance device having a larger center aperture than the center aperture shown in FIG. 2 and a top shelf about the perimeter of the device according to an aspect of the present disclosure.
Figure 18:
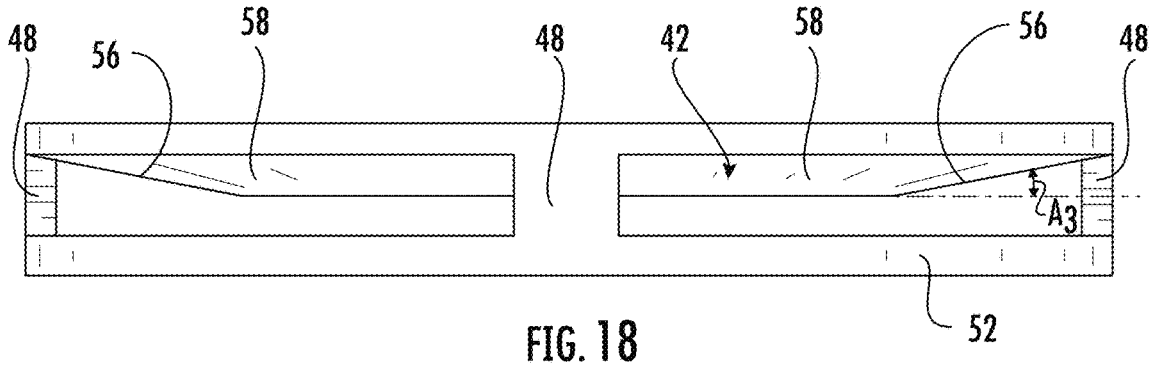
FIG. 18 is an elevated front view of an energy guidance device shown in FIG. 17 according to an aspect of the present disclosure.

The smokeless fire pit energy guidance devices 40 of the present disclosure typically include at least a top deflector disk 42 that is typically circular, but could conceivably be any shape. They are typically circular (but could be rectangular or another shape) and designed to engage or be seated on a top perimeter rim 44 of a smokeless fire pit or seated within a channel/top shelf 50. The dimensions may be adjusted but the center aperture of the energy guidance devices of the present disclosure are typically circular and have a diameter of any dimension between about 6 inches (see, for example D2 in FIG. 15) to a more typically diameter D1 shown in FIGS. 9A and 9B, which is about 10-14 inches, to a larger diameter D3 (See FIG. 17), which can be about 18 inches.

The dimensions vary based on the total scale of the energy guidance device. Typically, none of the energy guidance devices does not extend beyond the outer wall 14 of the smokeless fire pit or at least the outermost portion of the smokeless fire pit if the smokeless fire pit has a top shelf that might extend past the outer wall 14. As shown in FIGS. 2-14, the energy guidance devices may have a top perimeter rim 44 about the outermost circumference of the device and optionally an interior rim 46 between which is a channel/top shelf 50 that may be recessed to form a channel around the perimeter of the energy guidance device 40. The energy guidance devices of the present disclosure typically have a bottom smokeless fire pit engaging rim 52 and a plurality of supports 48 extending upward therefrom and suspending the top deflector disk 42. The number of supports 48 may vary but would typically be between three and 7-9 in order to provide the best stability of the devices while also allowing lateral airflow and energy transfer. The top deflector disk 42 in the aspects of the present disclosure shown in FIGS. 2-15 may be a solid piece with a flat top substantially planar or planar surface 60 and a typically at least partially angled deflecting surface 58 on the bottom, fire pit facing side of the overall top deflector disk 42. As shown in FIGS. 11-14, 16 and 18, the angle A can be anywhere from about 3 degrees to about 32 degrees depending on the diameter of the aperture in the center of the top deflector disk. A larger the aperture typically coincides with a larger the angle. The angle A can also vary depending on the height of the top deflector disk. The overall height of the top deflector disk itself from the bottom surface to the top planar surface is typically from about 1½ inches to about 2 inches, more typically about 1.65 inches. In the case of angle A1 in FIGS. 11-14, the angle would typically be from about 6 to 14 degrees, more typically from about 8 to 12 degrees and most typically about or exactly 8 degrees, but could be any angle depending on the variables discussed above. In the case of angle A2 in FIG. 16, the angle would typically be slightly less and typically from about 5 to 8 degrees. In the case of angle A3 in FIG. 18, the angle will be slightly larger than typical and would be in the range of from about 9 to about 14 degrees, but could be a more typically 8 degrees. Again, it will depend on the radius of the device 40 and the radius of the center aperture.

Figure 9B:
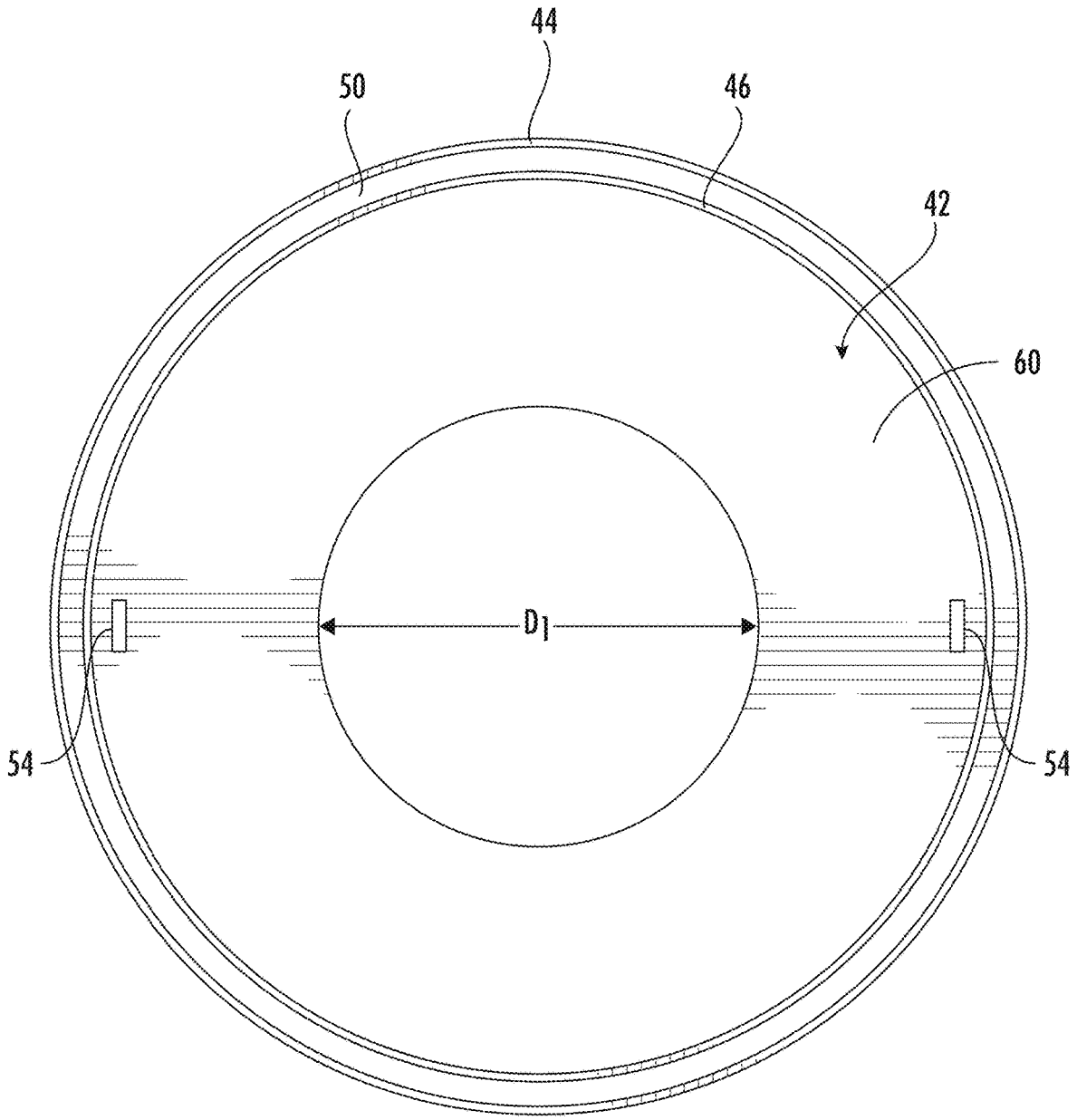
FIG. 9B is a top view of an energy guidance device according to an aspect of the present disclosure showing handle cutouts that may receive one or more lifting rods.
Figure 10:
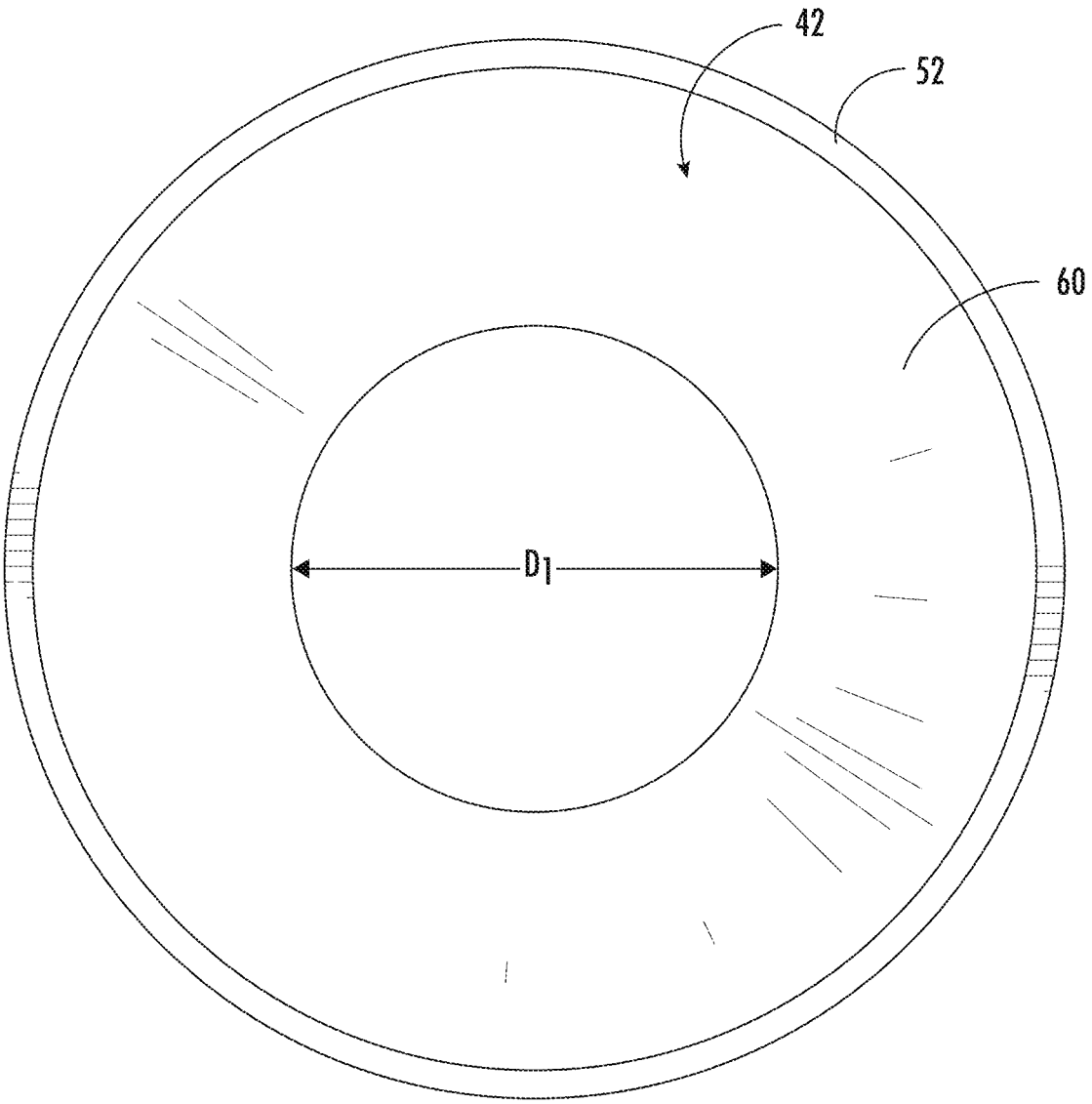
FIG. 10 is a bottom view of an energy guidance device according to an aspect of the present disclosure.

As shown in FIG. 9B it is possible to have handle cutouts 54 in a portion of opposite sides of the overall energy guidance devices. The handle cutouts may be any size or shape, but would typically be either straight lines as shown or two aligned grooves on each side to that lifting rods These may be only a few inches so as to not disrupt the functionality of the devices. They may be covered with a heat tolerant material to create a more appealing handle such as KEVLAR® or a rounded stainless steel or other heat tolerant metal. The overall energy guidance devices of the present disclosure may be produced from stainless steel or other heat resistant metal or a ceramic or combinations thereof. Typically, the entire device structure is produced form 20 gauge stainless steel, but could be any gauge, typically from 16 to 22 gauge may be used. The stainless steel used to make the energy guidance device of the present disclosure may be any finish but is typically a polished stainless steel to match a SOLO STOVER, which is also a polished stainless steel. The devices may have one or more notches in the interior aperture surface ring to allow a metal device to hook or grasp the overall energy guidance device and allow its removal from engagement with the smokeless fire pit while it is still exceedingly hot and unsafe to touch with a bare human hand. One or more apertures within the top deflector disk may also be used as a location to attach a handheld metal rod or tongs or other device to grasp the hot energy guidance device and facilitate its removal. Of course, as shown in the drawings, there are a number of gaps between the supports 48 that might also be used to put a rod or other device completely through the energy guidance device from one side to another and both sides grasped and lifted up to remove the device as well, but this would be less preferred as it would typically require two people to remove the energy guidance device from engagement with the smokeless fire pit.

Figure 1:
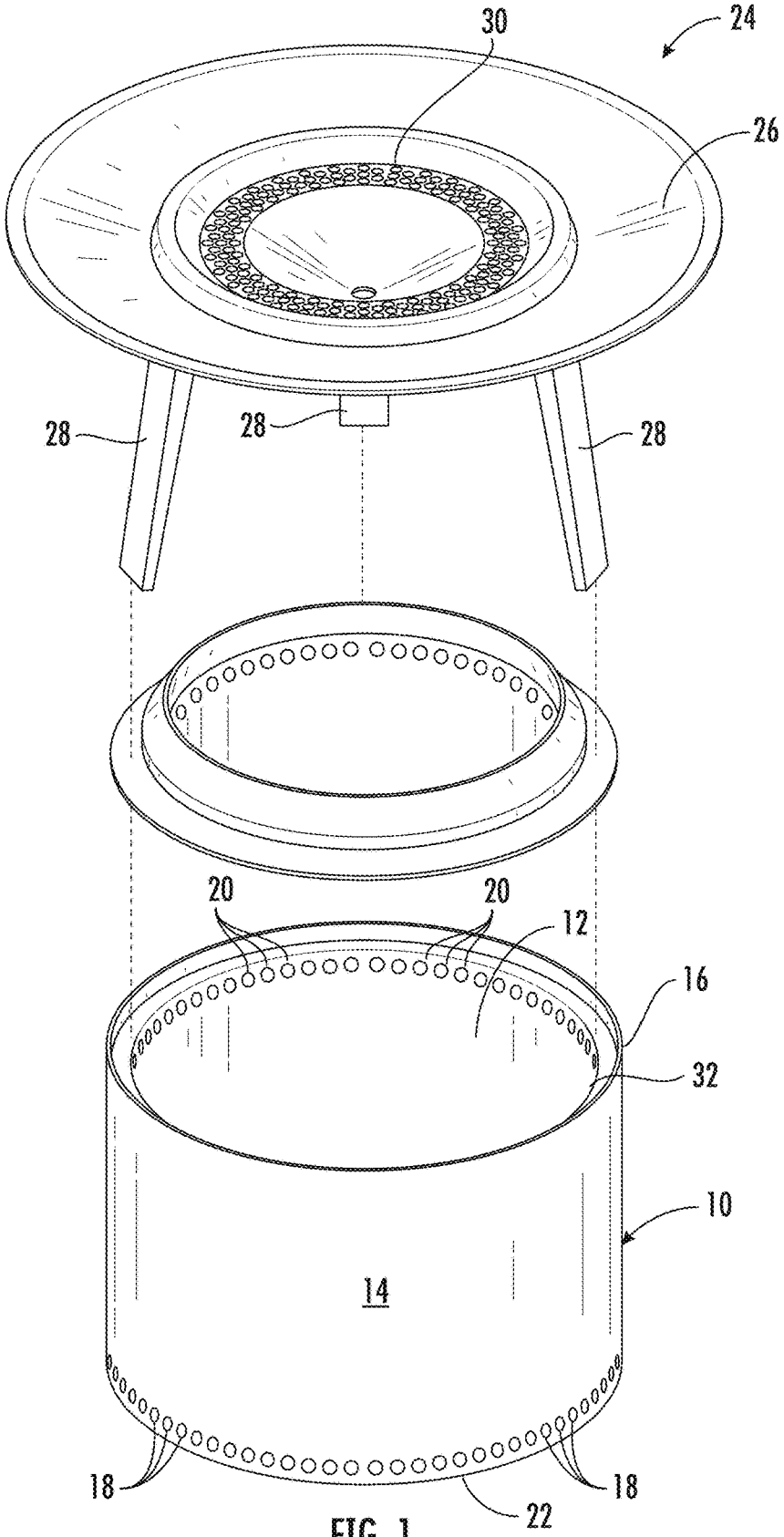
FIG. 1 PRIOR ART
FIG. 1 is a front perspective view of a Prior Art elevated covering heat deflector.
Figure 15:
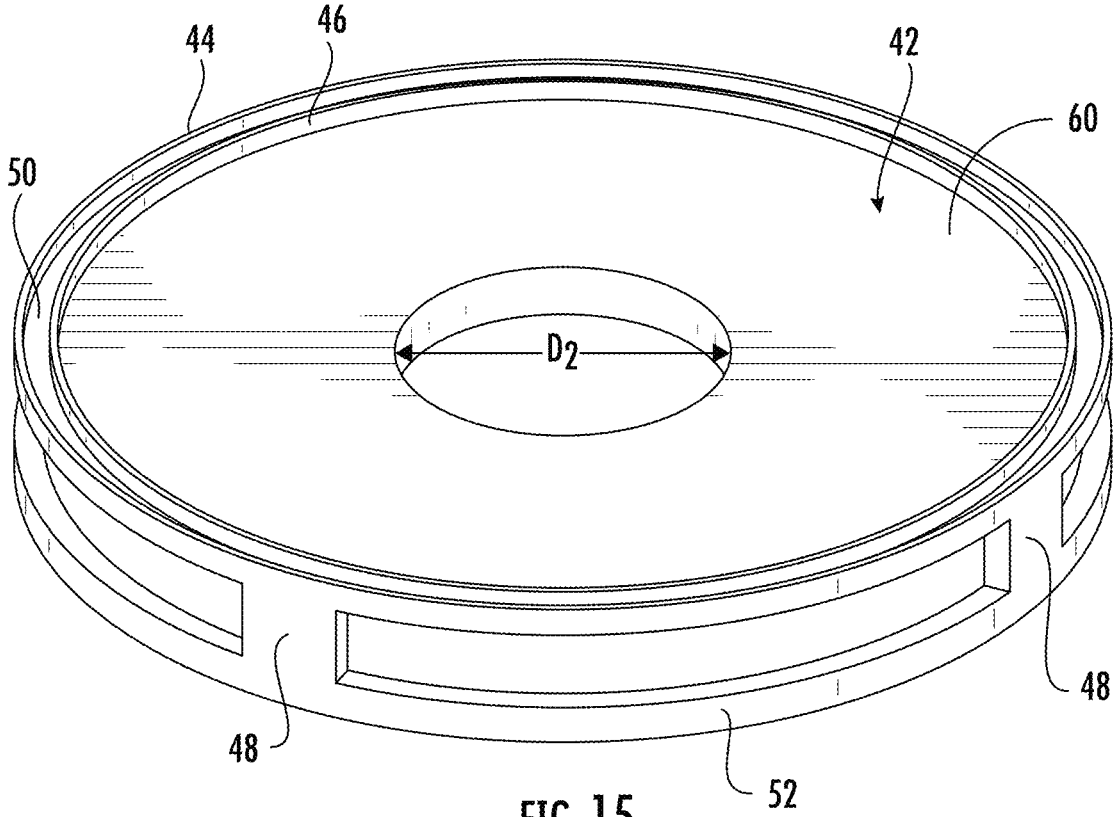
FIG. 15 is top front perspective view of an energy guidance device having a smaller center aperture than the center aperture shown in FIG. 2 and a top shelf about the perimeter of the device according to an aspect of the present disclosure.
Figure 16:
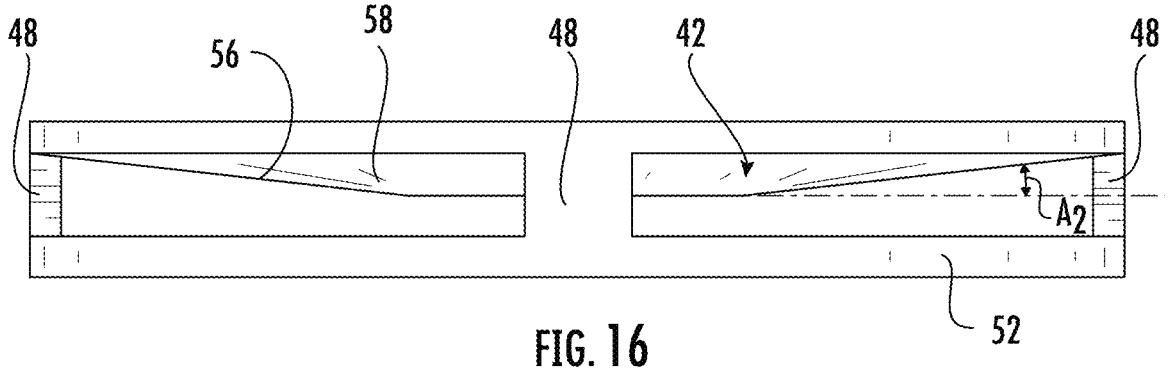
FIG. 16 is an elevated front view of an energy guidance device shown in FIG. 15 according to an aspect of the present disclosure.

As shown in FIG. 15, an accessory typically may be installed on top of the energy guidance devices of the present disclosure because the devices of the present disclosures typically have a top perimeter portion that this either flat or designed to mimic the top perimeter surface of the smokeless fire pit they are engaged with temporarily. A cast iron grilling grate is shown in FIG. 15 directly attached to the top surface of the energy guidance device. The cast iron grilling grate may be elevated using suspension legs if one wishes similar to the legs shown in FIG. 1, but engaging the top surface of the energy guidance device and the bottom surface of the cast iron grilling surface or other accessory.

Figure 5:
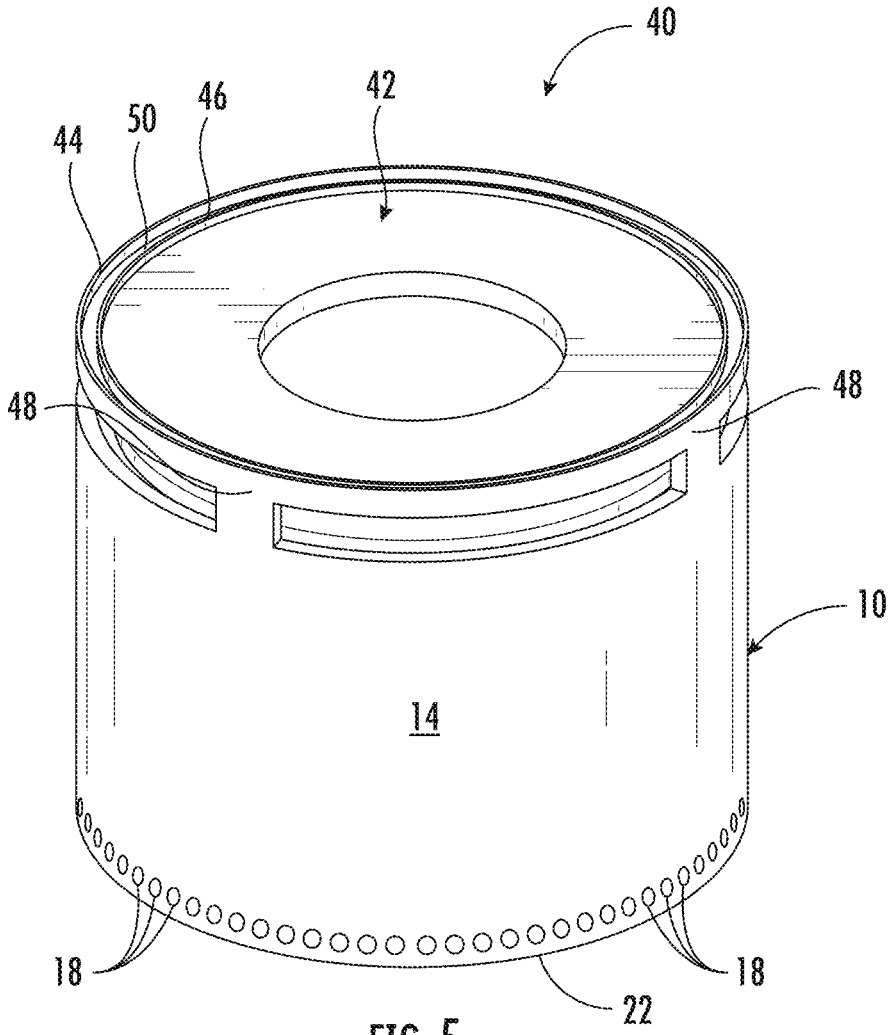
FIG. 5 is a front perspective view of an energy guidance device integrally formed into a top of a smokeless fire pit.
Figure 6:
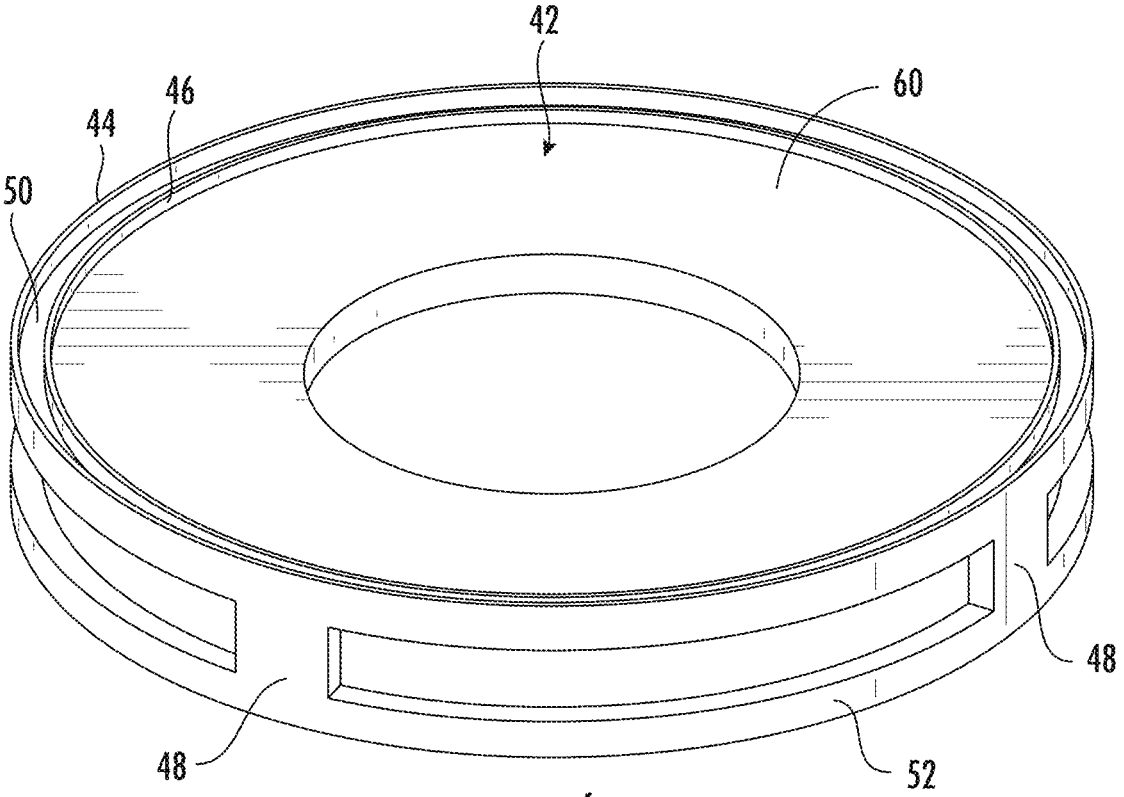
FIG. 6 is a top perspective view of an energy guidance device according to an aspect of the present disclosure.
Figure 7:
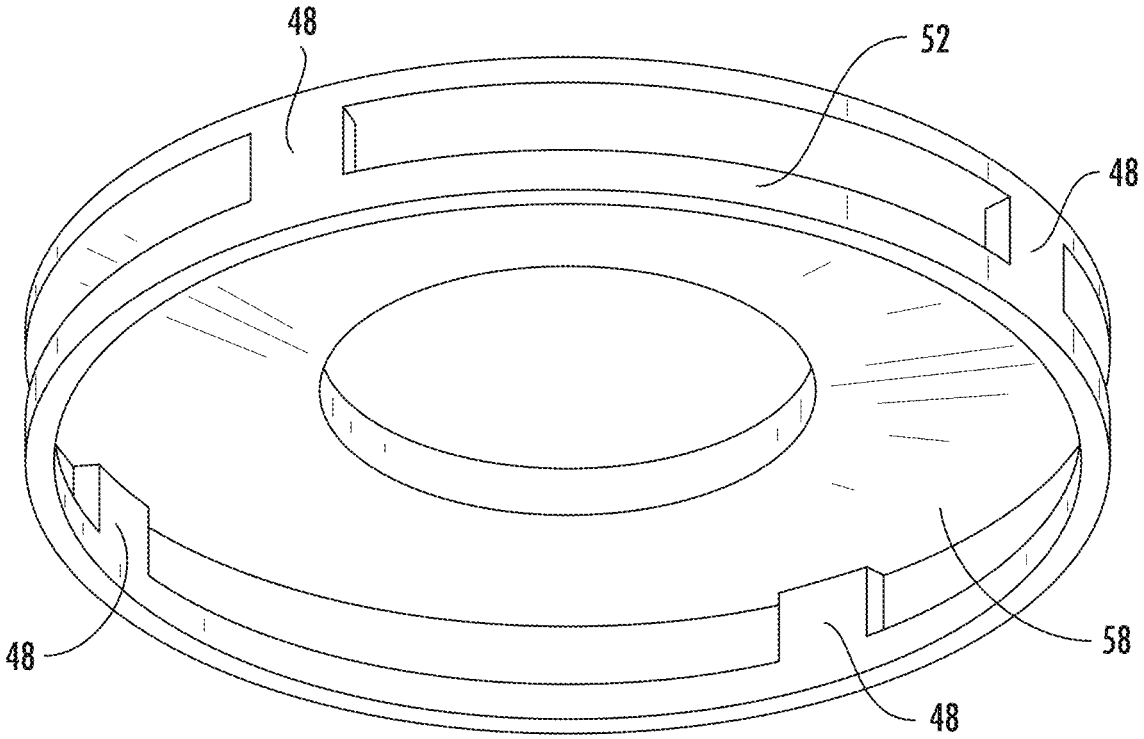
FIG. 7 is a bottom front perspective of an energy guidance device according to an aspect of the present disclosure.
Figure 8:
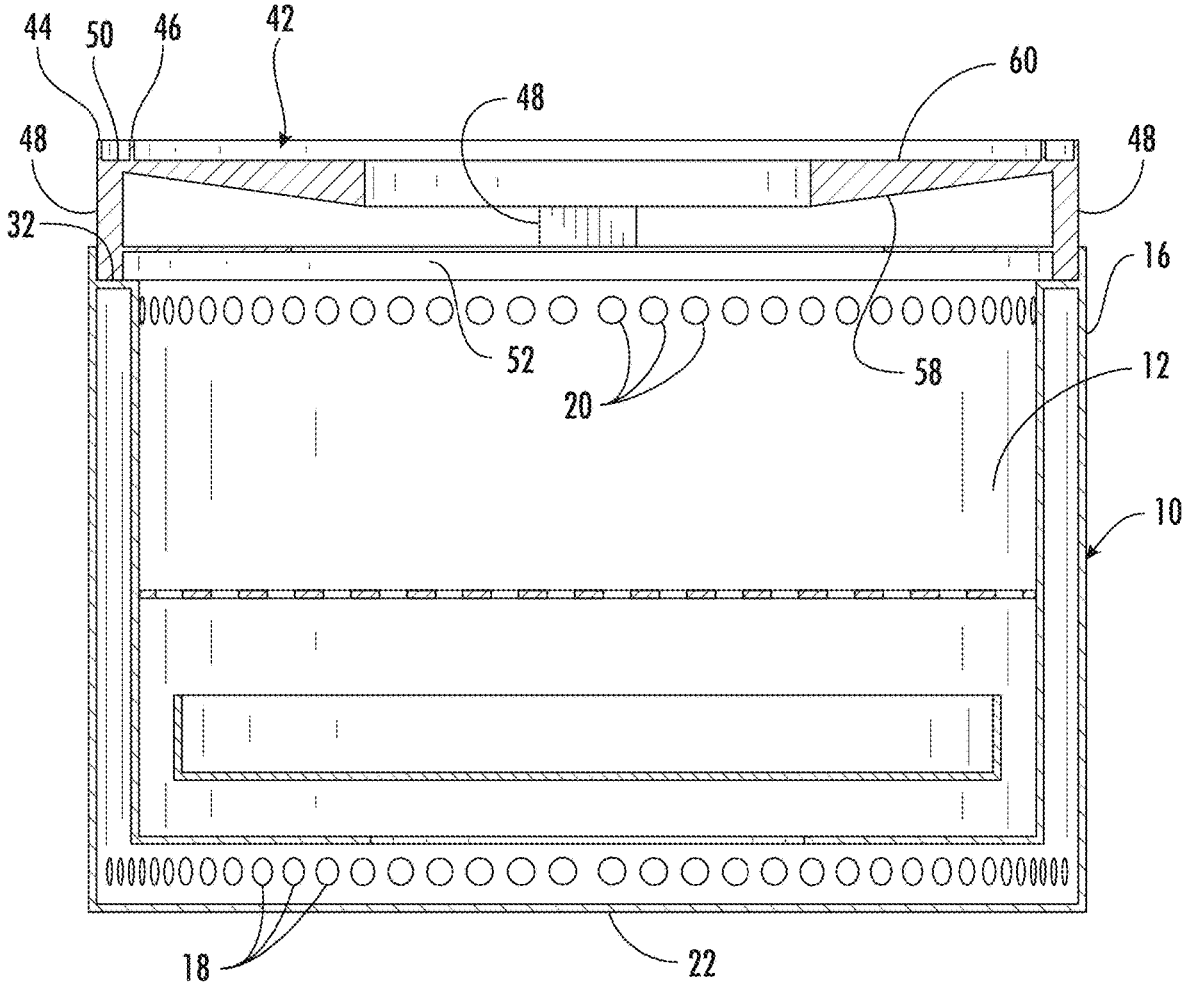
FIG. 8 is a cross-sectional view of the energy guidance device engaged with a smokeless fire pit taken along line VIII-VIII in FIG. 3.
Figure 19A:
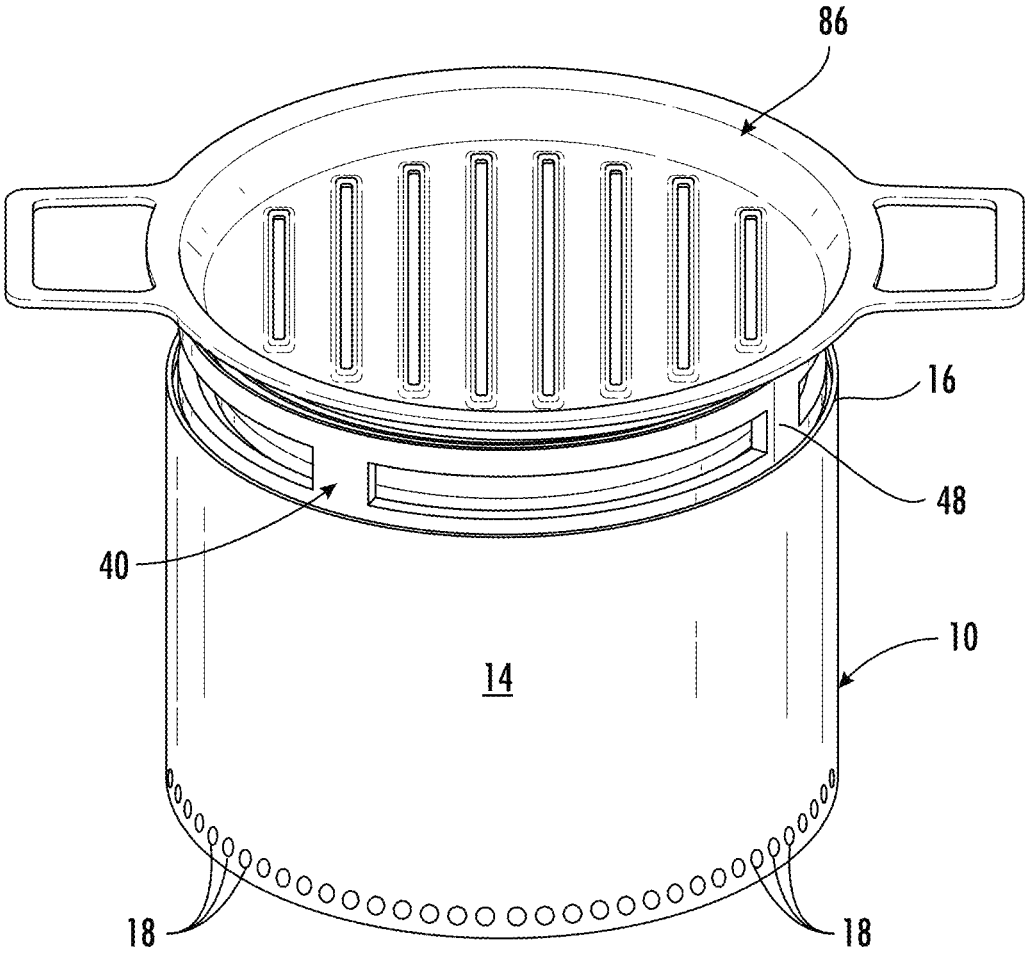
FIG. 19A is front perspective view showing an energy guidance device according to an aspect of the present disclosure with a cast iron grilling accessory engaged to the top of the energy guidance device.
Figure 19B:
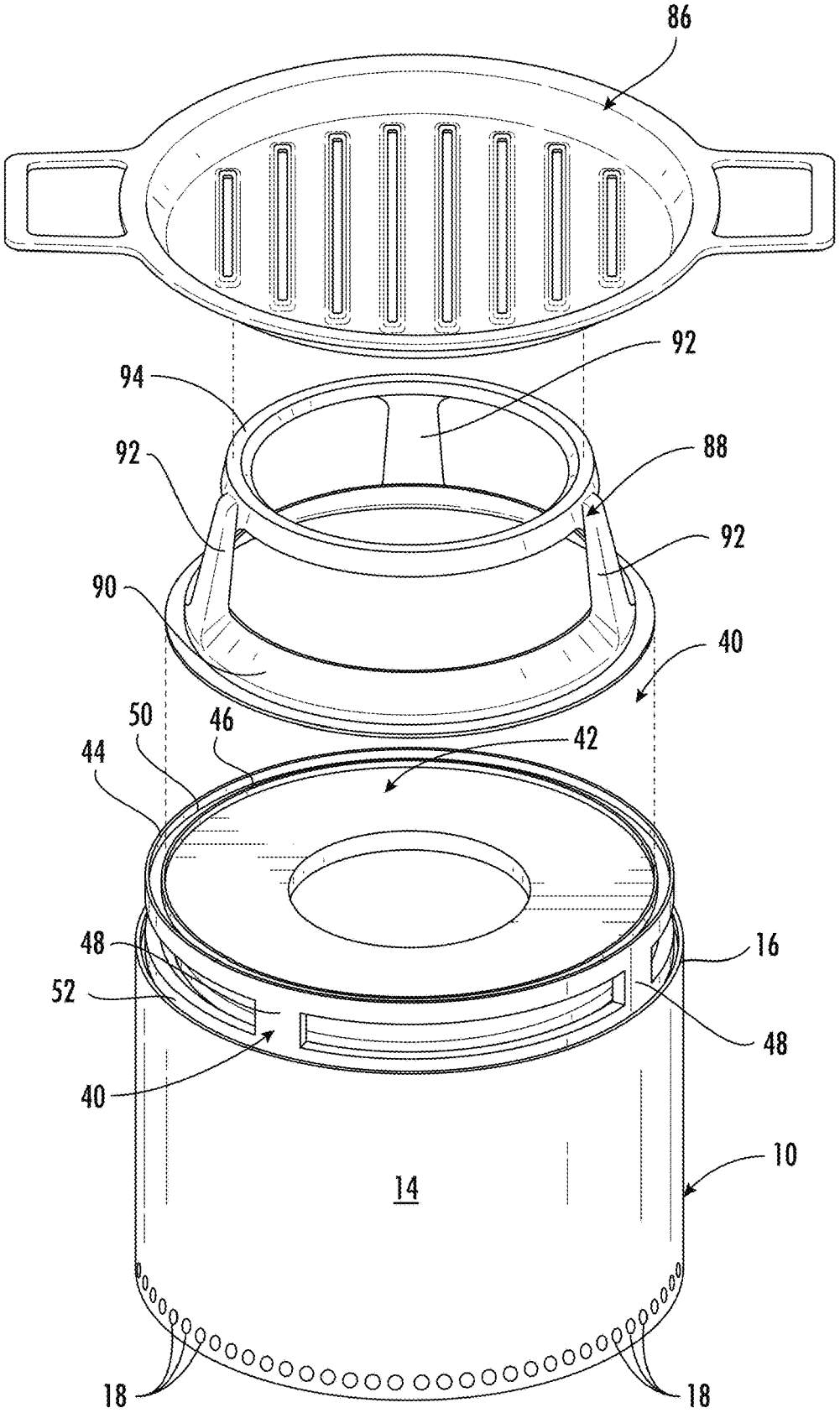
FIG. 19B is a front perspective view showing an energy guidance device according to an aspect of the present disclosure disposed between the top surface of the fire pit and a hub used to elevate a cast iron grille or other cooking surface above the flames and heat leaving the fire pit. The cast iron grill, the hub and the energy guidance device are typically held in engagement with one another by the force of gravity and may be removed from engagement by hand and without the use of tools (when the material is not too hot to touch)
Figure 19C:
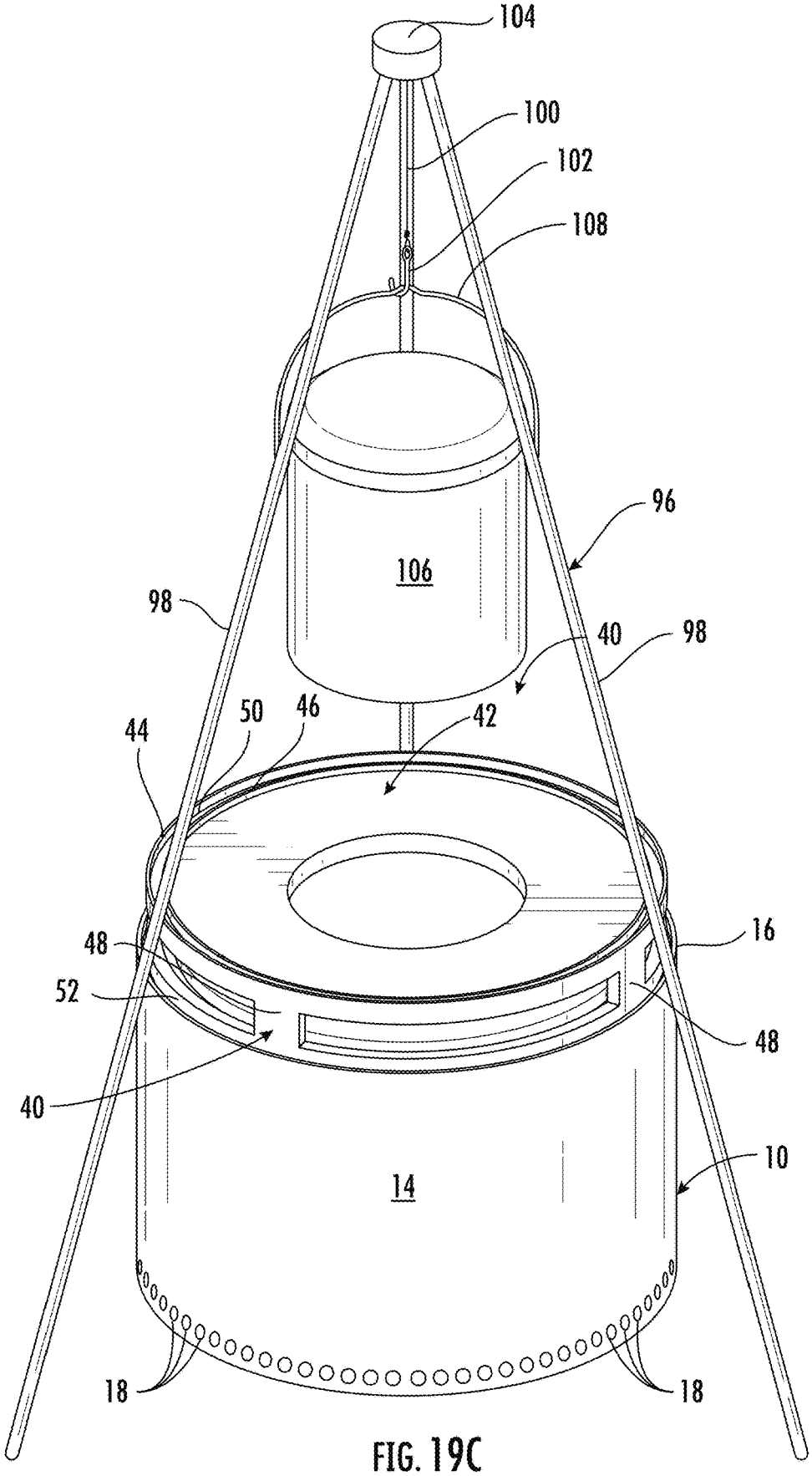
FIG. 19C is a front perspective view of a cooking tripod disposed around the smokeless fire pit having an energy guidance device of the present disclosure thereon and with a cooking container/pot suspended above the center or proximate the center of the energy guidance device.
Figure 19D:
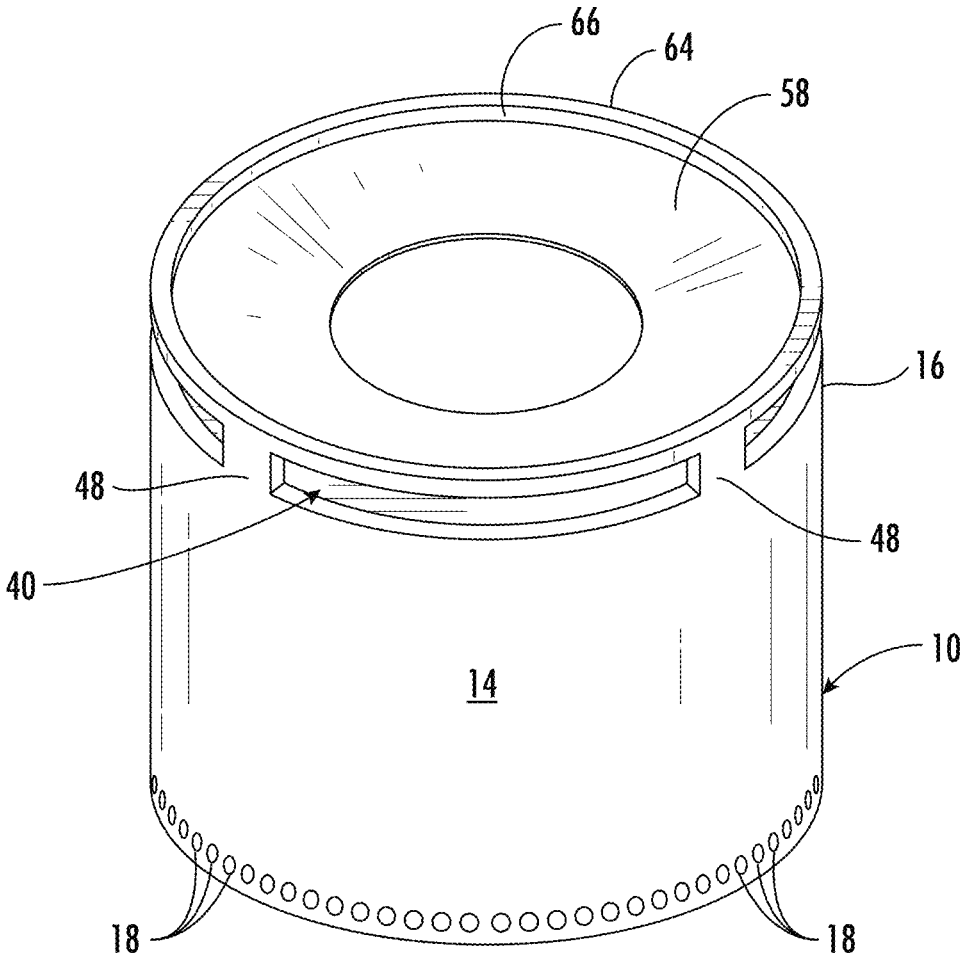
FIG. 19D shows an energy guidance device of the present disclosure integrated into a smokeless fire pit of the present disclosure without a top planar surface on the energy guidance device. A top planar surface is used to help engagement and use with other devices and systems, but is not typically necessary for the primary function of energy guidance or heat deflection whether the device is integrated into the fire pit or a separate device.

While the energy guidance devices of the present disclosure are described and shown herein as an accessory to be removably attached to the top surface of a smokeless fire pit by hand and without the use of tools, as shown in at least FIGS. 5 and 19D, the systems for heat deflection shown and described may be entirely integrated into a smokeless fire pit to create an entirely newly functioning smokeless fire pit. The systems of the energy guidance devices of the present disclosure may be completely integrated and unitary with the other components and walls of the smokeless fire pit or produced separately and fixedly engaged to the smokeless fire pit by one or more spot welds, rivets, a metal fastener or laser welding or other ways metals may be permanently attached metal components together.

As shown in FIGS. 20-24, the top deflector disk 42 does not need to be a solid element, but can be construct of an optional top planar surface (not shown in FIG. 20, which still functions to create a surface to engage other accessories of the overall smokeless fire pit system), an at least partially angled deflection surface 58 and a bottom support 62. Each of the components are typically in the form of a planar plate of stainless or polished stainless steel material or other material capable of maintaining its structural integrity at temperatures above 1000 degrees Fahrenheit. The side wall 64 may be solid, but typically has a plurality of openings in it to facilitate viewing of the fire inside the smokeless fire pit when the energy guidance device is engaged and in use. The energy guidance devices of this construction typically have an interior surface 66 of a side wall 64 that is typically visible from the top and from the bottom because at least the top planar surface and the bottom planar surface are typically recessed or elevated from the top rim 64 and bottom rim of the side wall(s) 64. However, the top planar surface (when used), the at least partially angled deflection surface, and/or the bottom support might not be recessed and might be positioned at the bottom end 72 or top end 68 of the side wall 64. The interior surface 66 may also not be visible from the top and the top planar surface might engage or be integrally formed with the top end 68 of the side wall 64. Similarly, the interior surface may also not be visible from the bottom because the bottom support 62 may be engaged or integrally formed with the bottom end 72 of the bottom rim 70 of the side wall 64. The bottom end 72 is also typically the bottom smokeless fire pit engaging rim 52. The interior partially angled deflecting surface may be engaged at or proximate the top rim of the side wall as well.

In the typical configuration the diameter of the center aperture of the bottom support defined by the bottom support aperture perimeter 74 should be wider/greater than the center aperture of the partially angled deflection surface defined by the angled deflection surface aperture perimeter 76 and the center aperture of the top planar surface defined by the center aperture perimeter 78 of the top planar surface when the top planar surface is optionally employed. The center aperture of the bottom support is typically about 15-17 inches in diameter, but more typically about 16 inches. The center aperture of the partially angled deflection surface and the center apertures of the top planar surface are typically from about 11-13 inches, and more typically about 12 inches.

Figure 11:
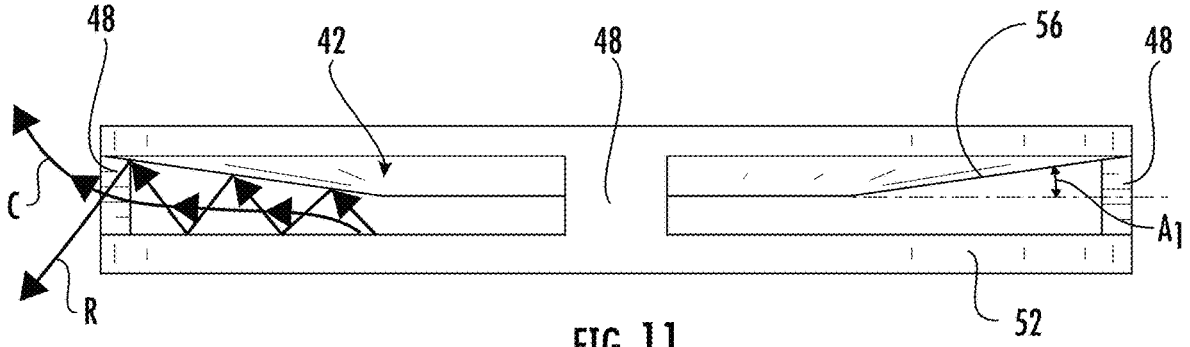
FIG. 11 is an elevated front view of an energy guidance device according to an aspect of the present disclosure showing how convective and radiant energy is caught and transferred laterally using the energy guidance device of the present disclosure.
Figure 12:
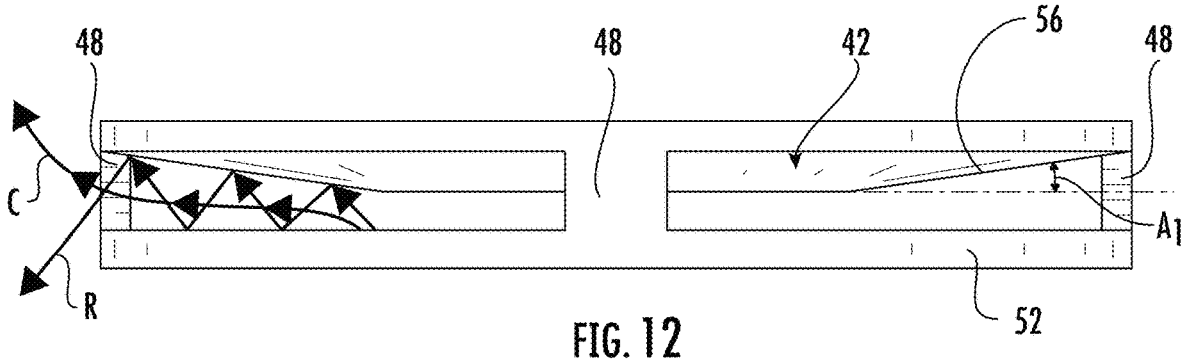
FIG. 12 is an elevated rear view of an energy guidance device according to an aspect of the present disclosure showing how convective and radiant energy is caught and transferred laterally using the energy guidance device of the present disclosure.
Figure 13:
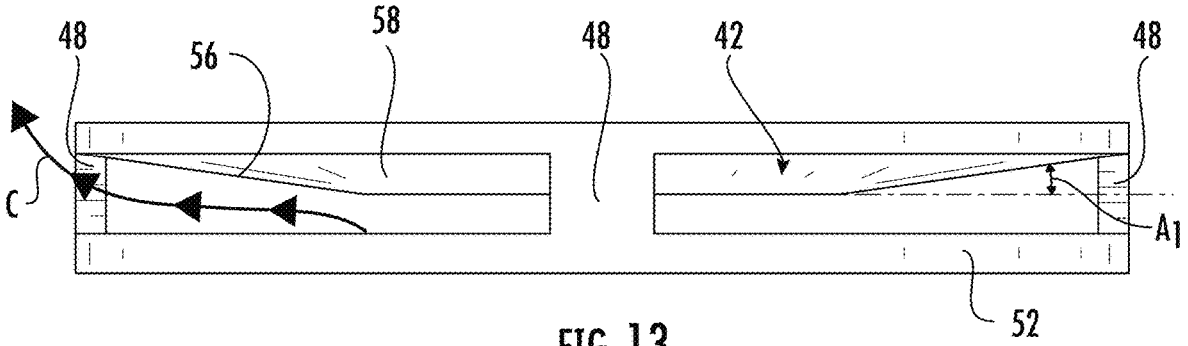
FIG. 13 is an elevated left view of an energy guidance device according to an aspect of the present disclosure.
Figure 14:
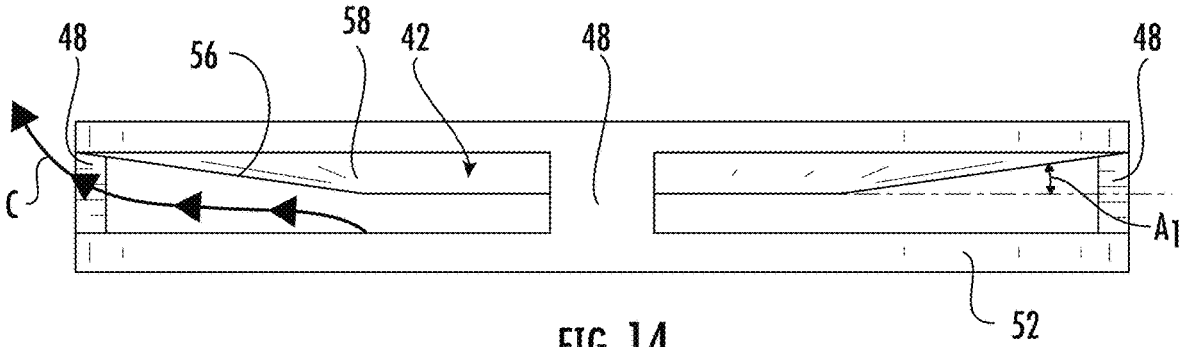
FIG. 14 is an elevated right view of an energy guidance device according to an aspect of the present disclosure.
Figure 24:
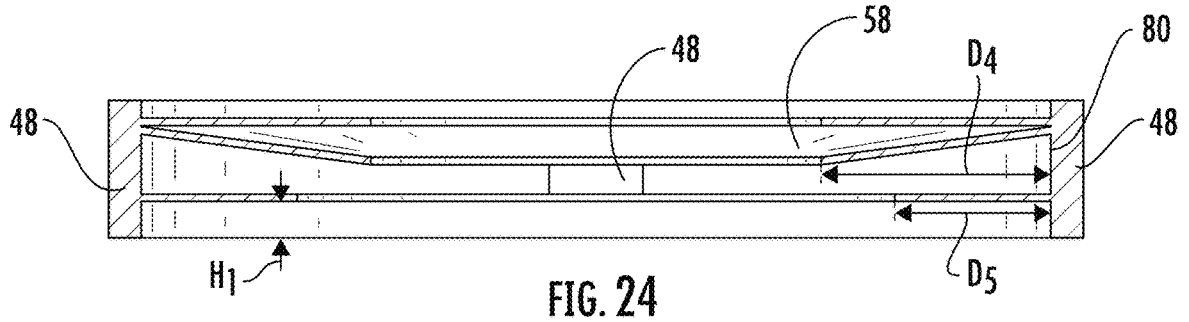
FIG. 24 is a cross sectional view of an energy guidance device according to an aspect of the present disclosure taken along line XXIV-XXIV in FIG. 23.
Figure 25:
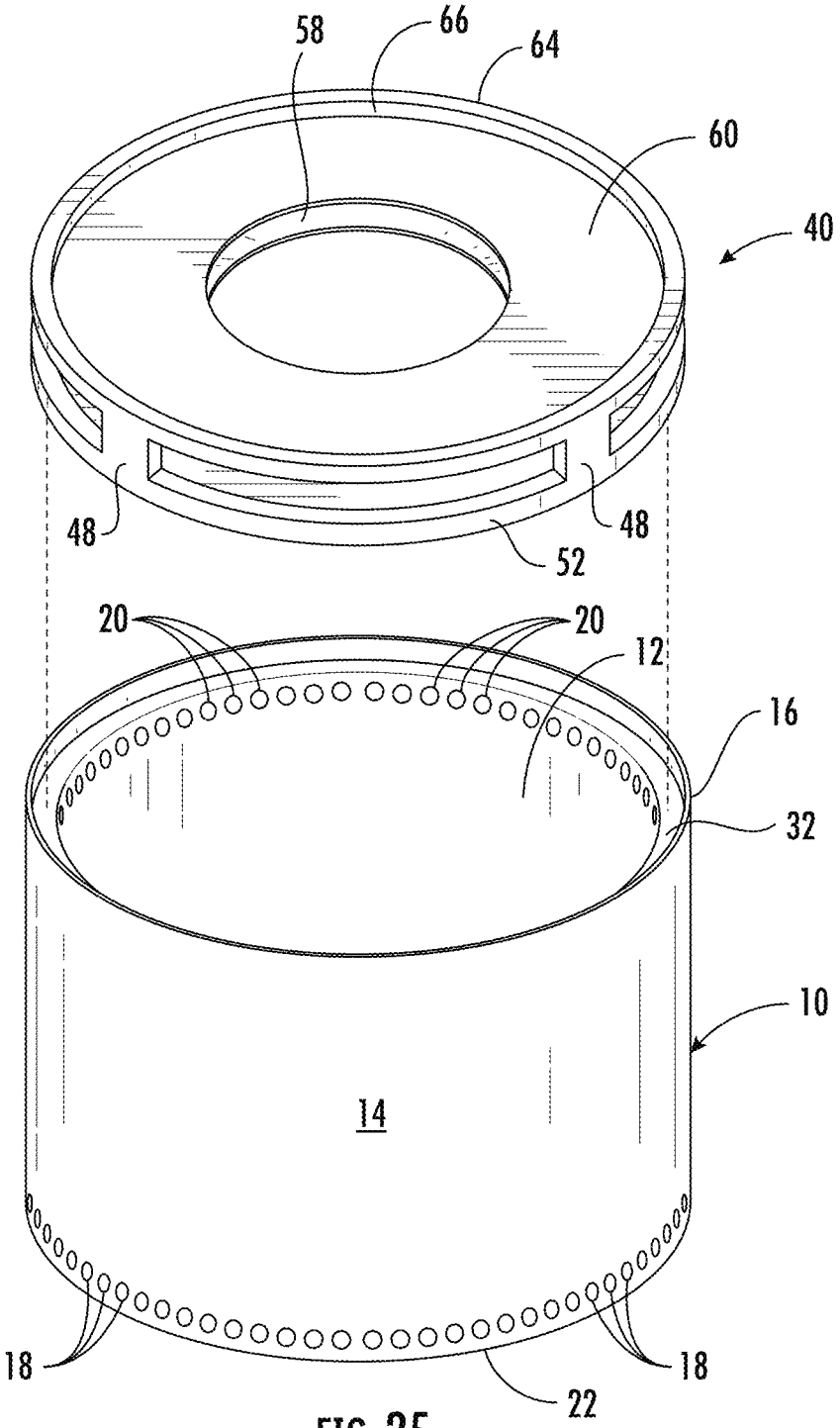
FIG. 25 is an exploded perspective view showing engagement of the energy guidance device shown in FIG. 21 with a smokeless fire pit.
Figure 26:
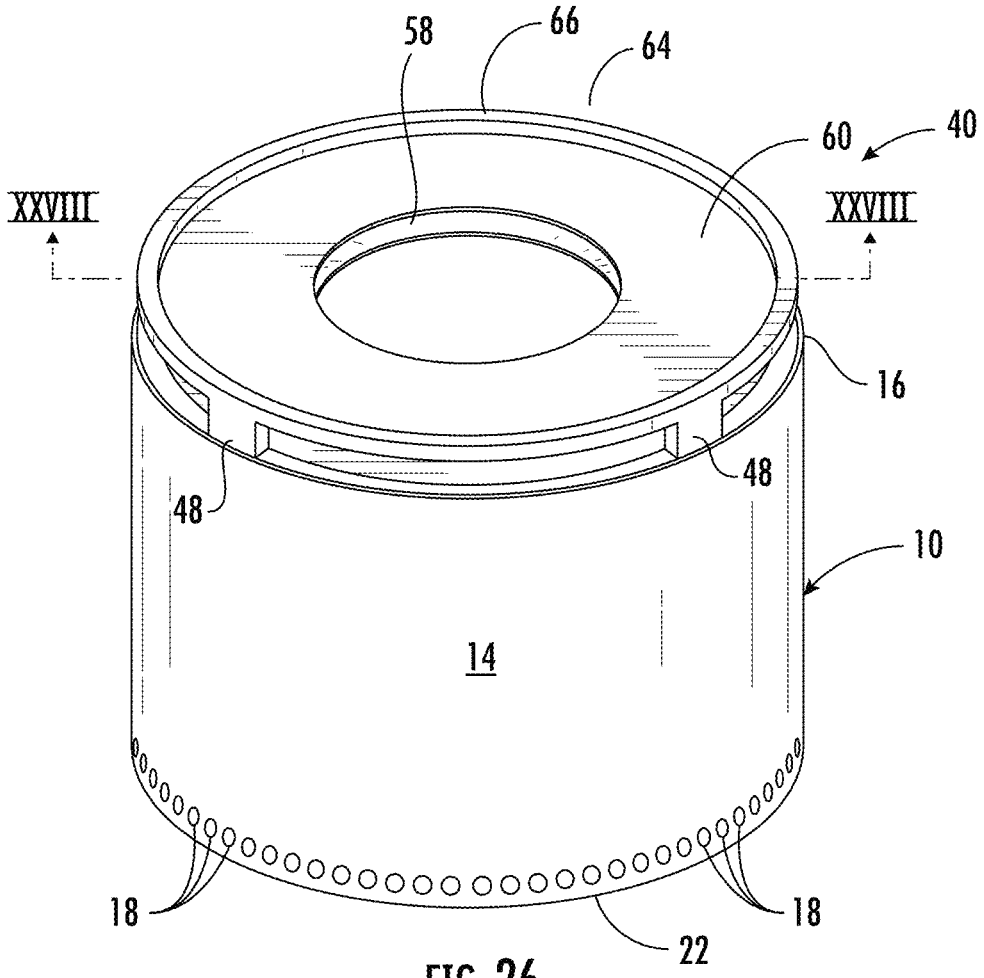
FIG. 26 is a perspective view showing the energy guidance device of FIG. 21 engaged with the top portion, in this case the perimeter rim, of a smokes fire pit. The energy guidance device may be engaged and disengaged by hand and without the use of tools (assuming temperature is acceptable)
Figure 27:
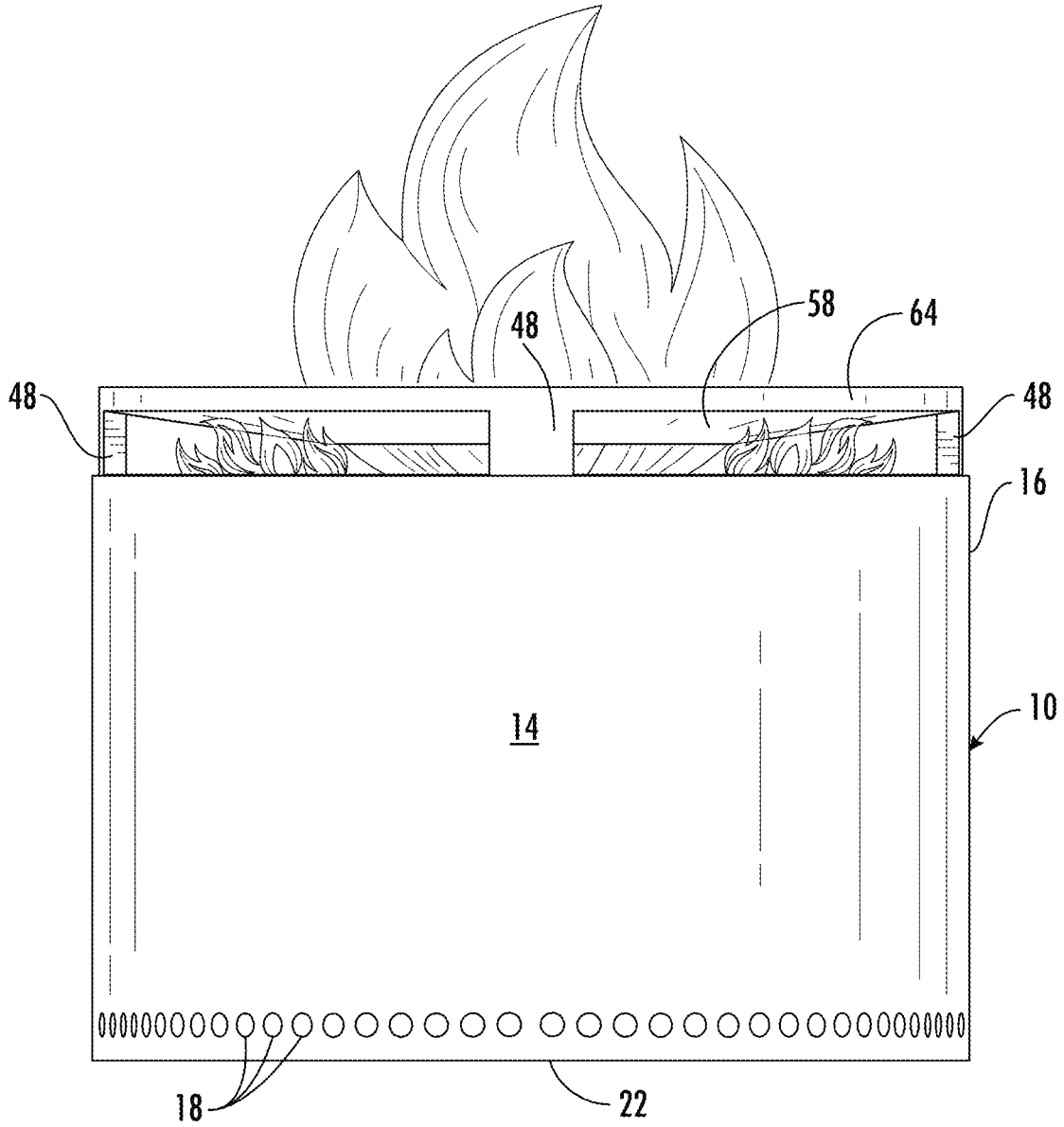
FIG. 27 is an elevated front view showing the system of FIG. 26 in use with the fire extending through the center of the energy guidance device and showing radiant and convective heat energy extending laterally.
Figure 28:
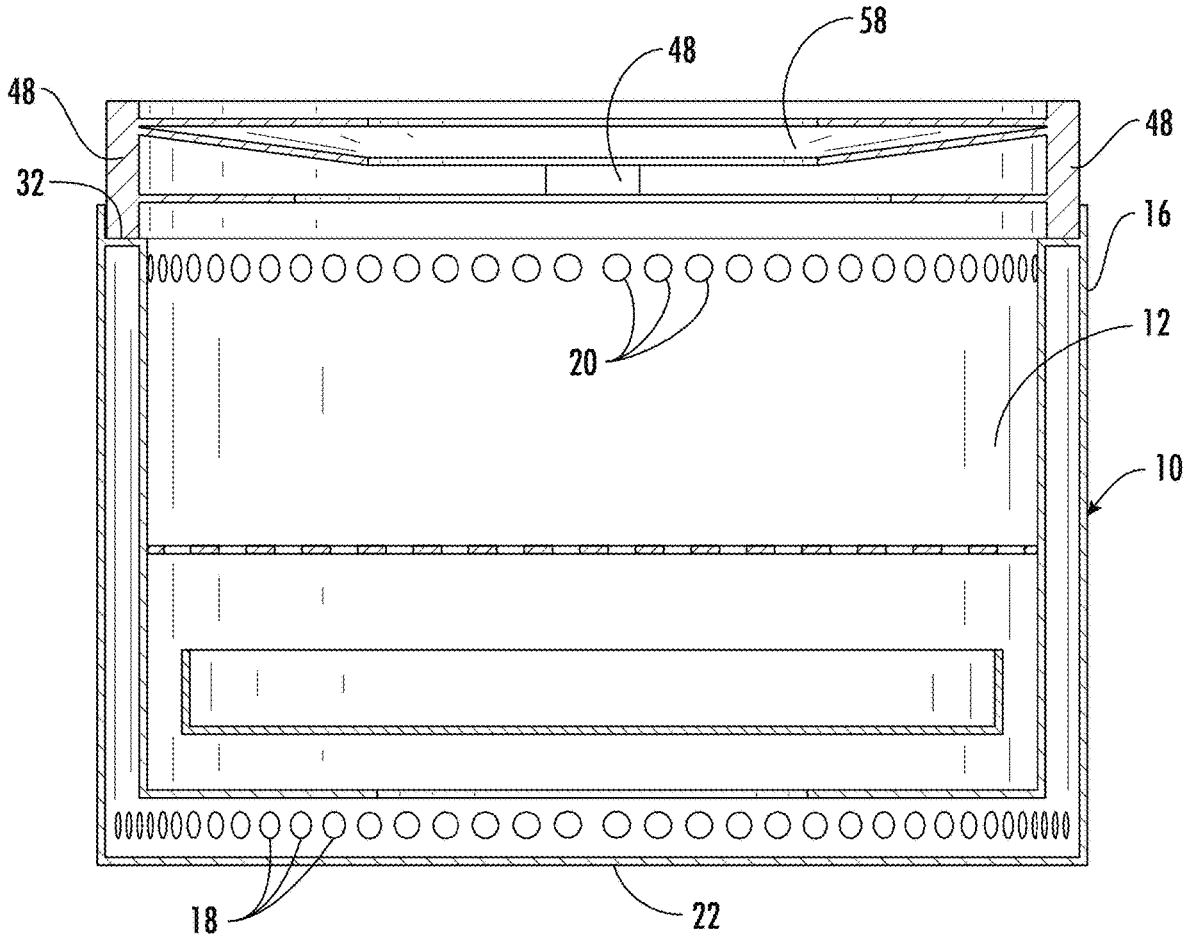
FIG. 28 is a cross-sectional view taken along line XXVIII-XXVIII in FIG. 26.

As shown in FIG. 24, the distance D4 from the interior facing surface 80 of the supports 48 to the angled deflection surface aperture perimeter is greater than the distance D5 from the interior facing surface 80 of the supports 48 to the bottom support aperture perimeter 74. As shown in FIGS. 11 and 12, the energy from the fire pit is received by the overhanging portion 82 of the partially angled deflection surface and directed outwardly toward those seated around the smokeless fire pit. Typically, both convective heat energy designated with the symbol "C" and radiant energy "R" are laterally dispersed, which creates a warm and more traditional fire pit feeling to those sitting around the smokeless fire pit. This principle works similarly in the design shown in FIGS. 21-24. This configuration also amplifies the fire by focusing heat in the cylindrical pattern in a fashion where the area of the fuel source (wood) is greater than the area of output of the energy. In this case the area is the top aperture of the partially angled deflection surface and the center apertures of the top planar surface, if employed. The bottom support also serves to further directed heated air from the hot air outlets 20 across the bottom, fire pit facing side surface 84 of the bottom support 62 still further focusing the heat energy and further eliminating and improving the function of the smoke removal aspects of the original smokeless fire pit. This is more effective when the bottom support 62 is engaged to the bottommost end of the supports such that the bottom support is closest in position to the top of the plane defined by the hot air outlets. The ash and heat energy used to further burn the ash are put into even closer proximity in this design than in the standard design of the smokeless fire pits that do not employ the energy guidance device of the present disclosure.

As shown in FIG. 19A the energy guidance devices of the present disclosure may be used with other accessories such as a cast iron griddle or other cooking surface 86, which may be mounted directly on the top of the energy guidance device 40 or, as shown in FIG. 19B suspended above the fire within the fire pit and above the focused heat and light energy column extending upward from the center of the smokeless fire pit using a hub 88. The hub 88 may engage the perimeter of the energy guidance device in much the same manner as it would engage the perimeter rim of the smokeless fire pit in a manner such that it will not slide off of engagement with the energy guidance device 40. Typically, the energy guidance device 40 will have a top perimeter rim 44 to hold the hub 88. The hub 88 typically has a circular base portion 90 and a plurality of upwardly extending legs 92 that extend between the circular base portion 90 and the top accessory engaging rim 94.

In another aspect of the present disclosure, because the energy guidance device amplifies the already focused energy extending upward from the smokeless fire pit even more in the center of the overall systems, a tripod cooking system 96 having legs 98 and a downwardly extending cooking pot hanger 100 with a hook 102 at the end opposite the top apex junction 104 of the junction of the legs 98. The cooking pot or other cooking container 106 that may or may not have a lid typically hangs from the hook 102 using an arched handle 108 similar to a paint can handle. However, the handle may be any shaped configuration that engages the hook.

Figure 20:
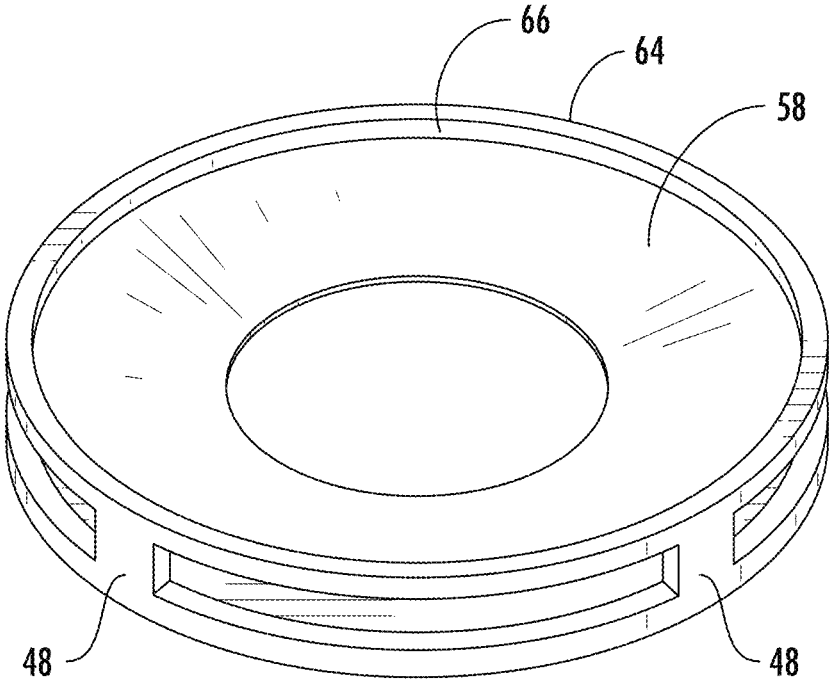
FIG. 20 is a front perspective view of an energy guidance device according to an aspect of the present disclosure without a top planar surface, but with the partially angled deflecting surface being the top surface of the overall energy guidance device.
Figure 21:
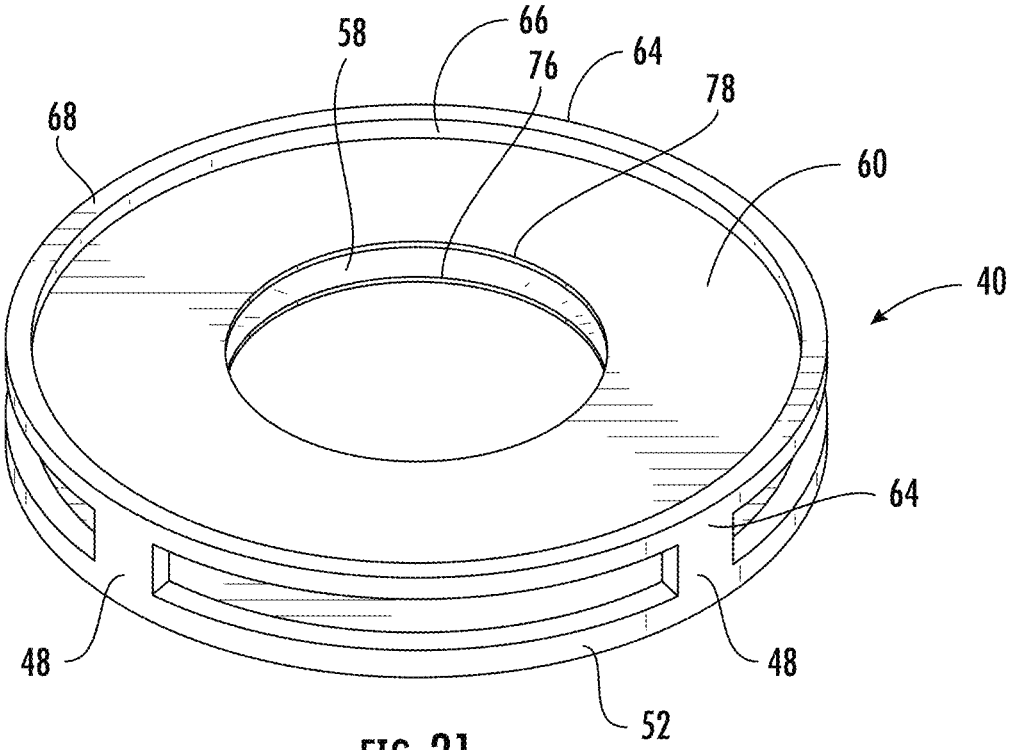
FIG. 21 is a top front perspective view of an energy guidance device according to an aspect of the present disclosure where the top deflector disk is not solid, but has a gap therebetween with a top planar surface, the partially angled deflecting surface and the bottom support.
Figure 22:
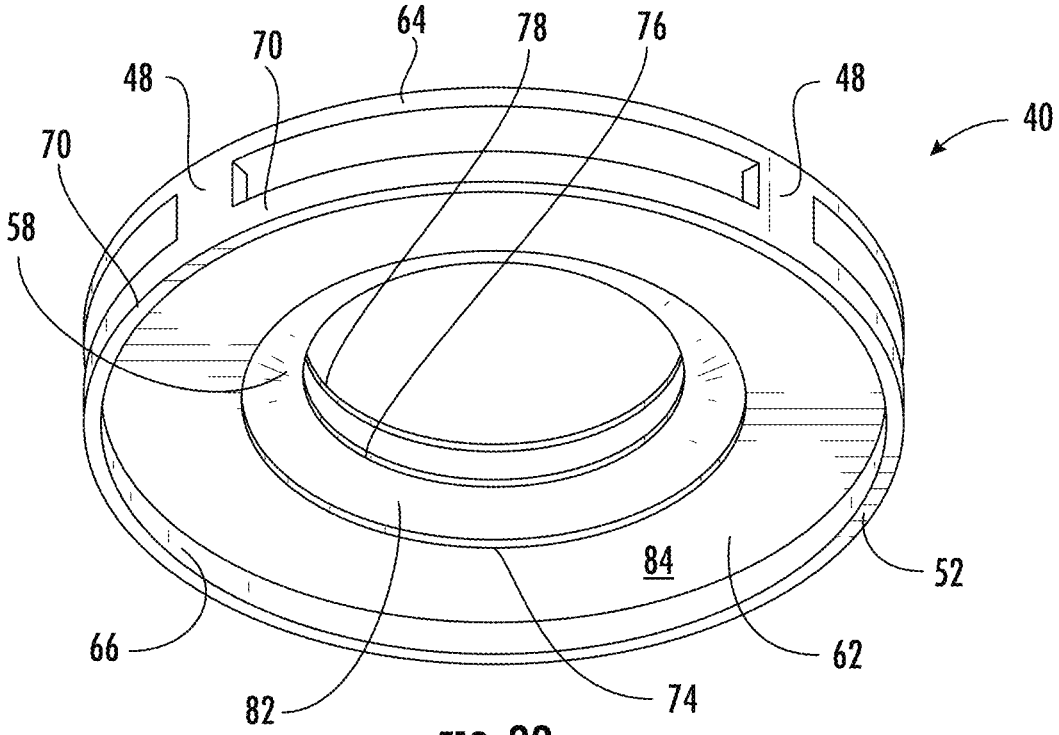
FIG. 22 is a bottom front perspective view of an energy guidance device according to an aspect of the present disclosure where the top deflector disk is not solid, but has a gap therebetween with a top planar surface, the partially angled deflecting surface and the bottom support.
Figure 23:
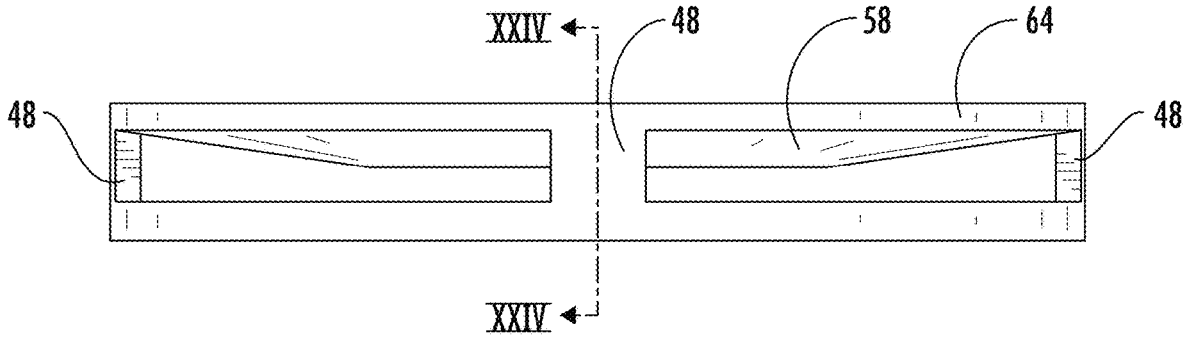
FIG. 23 is a side view of an energy guidance device according to an aspect of the present disclosure where the top deflector disk is not solid, but has a gap therebetween with a top planar surface, the partially angled deflecting surface and the bottom support.

FIG. 19D shows an energy guidance device of the present disclosure integrated into a smokeless fire pit of the present disclosure without a top planar surface on the energy guidance device. A top planar surface is used to help engagement and use with other devices and systems, but is not typically necessary for the primary function of energy guidance or heat deflection whether the device is integrated into the fire pit or a separate device. The energy guidance device of this embodiment does not utilize the top generally planar surface, but instead only uses the at least partially angled deflecting surface 58 and the bottom support, but the bottom support may be eliminated as well in this embodiment due to the integration of the device with the overall smokeless fire pit. However, the bottom portion is typically employed so has to have the staggered/overlapping portion between the partially angled deflecting surface 58 and the bottom surface. Elimination of the bottom surface does not allow the radiant heat energy to be laterally transmitted because there is not a surface for the radiant energy to reflect and be transmitted laterally. Not employing the bottom surface also typically forms a less amplified fire within the fire pit. The energy guidance device may be separately formed without a top generally planar surface as shown in FIG. 20. A top generally planar surface 60 may or may not be employed, but when employed it is typically used to allow engagement of the hub 88 or other fire pit accessory with the energy guidance device.

Figure 29:
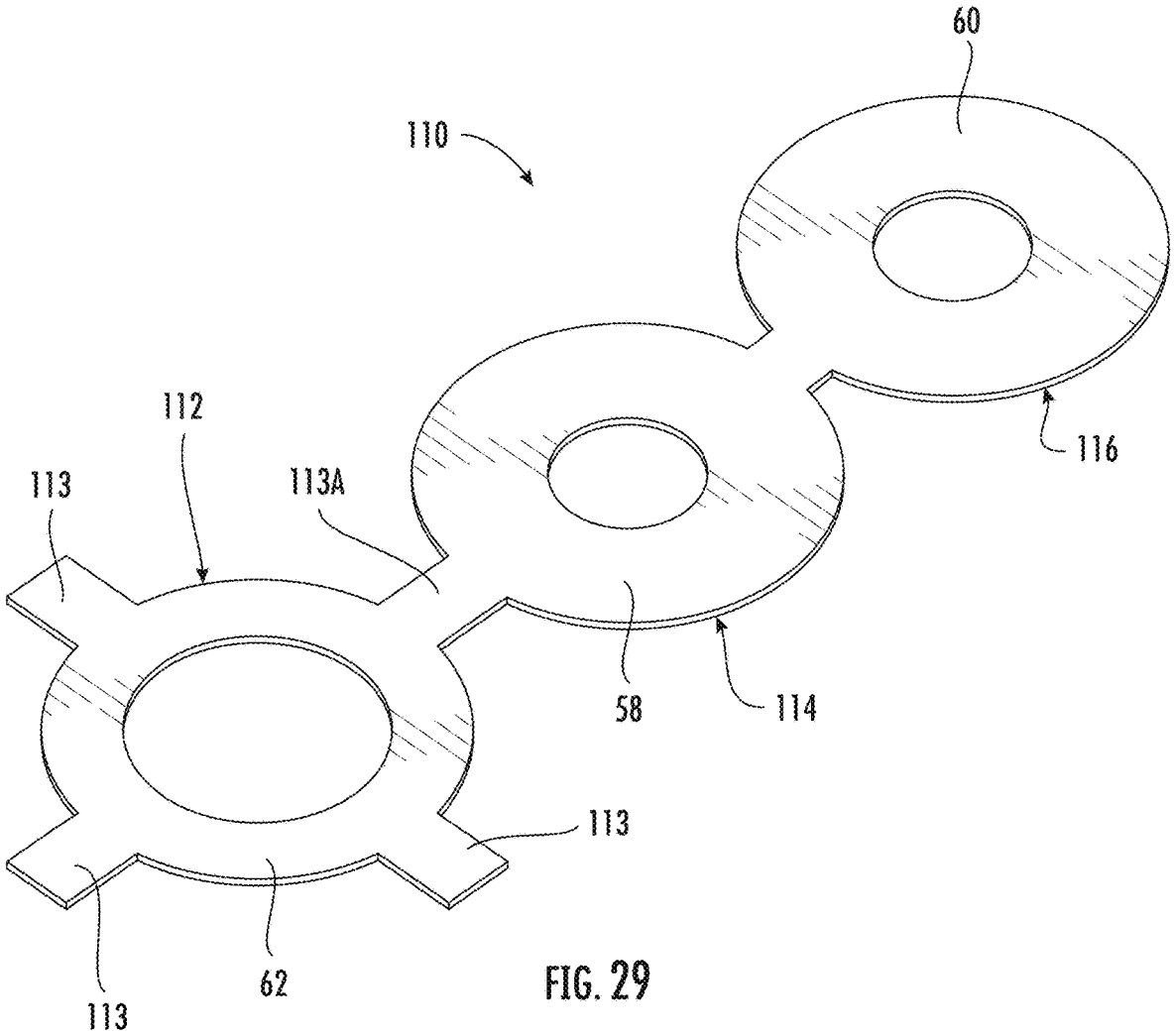
FIG. 29 is a perspective view showing a cut stainless steel piece of material prior to the material being bent to form an energy guidance device according to an aspect of the present disclosure.
Figure 30:
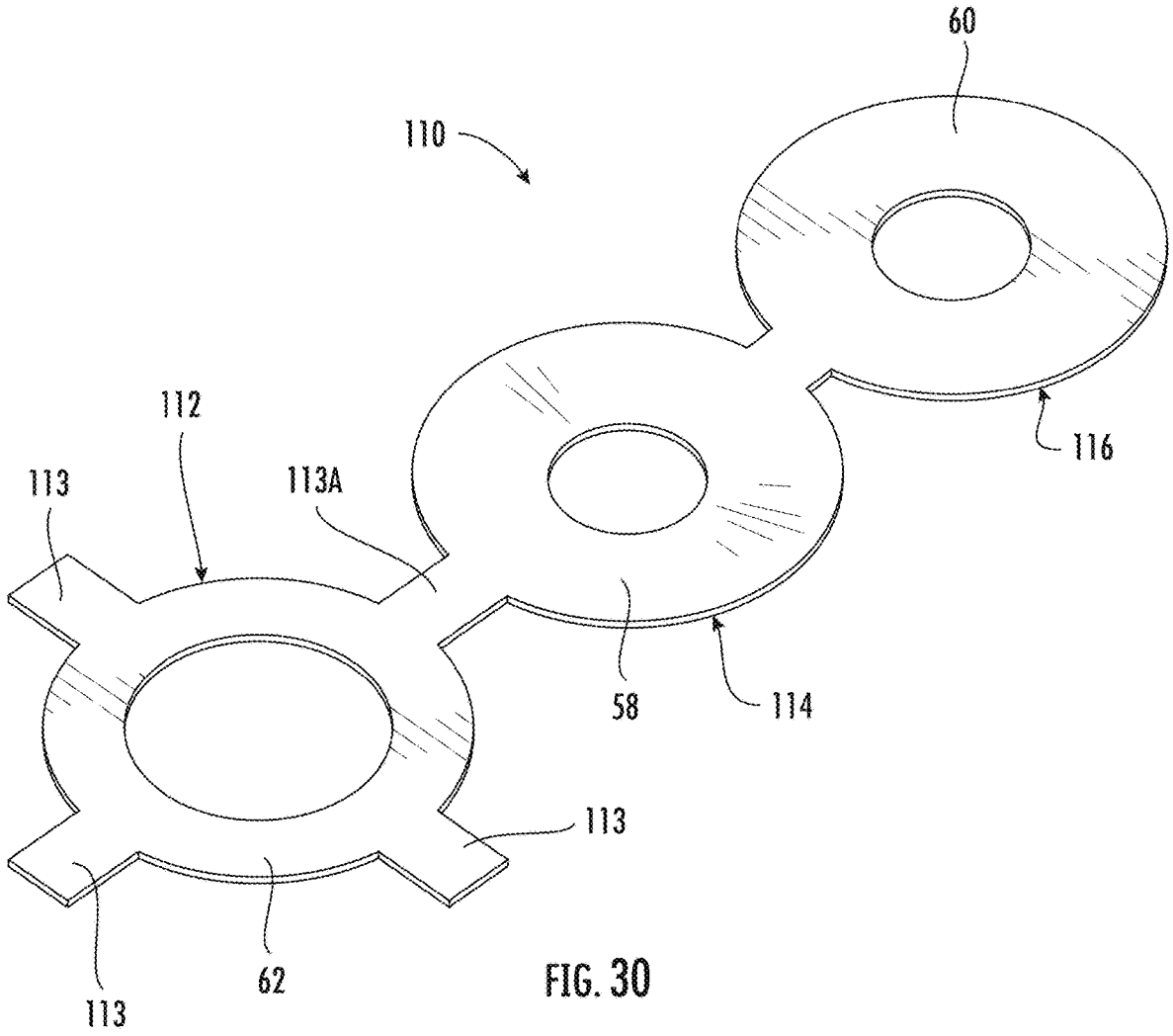
FIG. 30 is a perspective view showing the center portion of the stainless steel piece of material stamped to form the conical/angled portion of an energy guidance device according to the present disclosure.

FIGS. 29-33 show a method one may be able to construct an energy guidance device according to an aspect of the present disclosure by first cutting, typically laser cutting or high pressure water cutting or CNS machining, to form a starting flat foldable design 110 and thereafter stamping the ring-shaped center section thereof to for the at partially angled deflecting surface 58, and then folding the various segments prior to fastening or welding them together. As shown in FIG. 29, a flat planar cut sheet of stainless steel has a cut bottom portion 112 that forms the bottom support 62 in the final construction according to this aspect of the present disclosure. The cut bottom portion 112 has three rectangular-shaped sections 113 and one rectangular-shaped section 113A section that interconnects to the ring-shaped center section 114 that is stamped to form the at least partially angled deflecting surface 58. The rectangular sections are later bent at the joints to form the supports 48 in the finished design. They are bent after the ring-shaped center section 114 is stamped or otherwise formed into the at least partially angled deflecting surface 58. The center section might be machined into the at least partially angled deflecting surface 58, but would typically be stamped.

Figure 31:
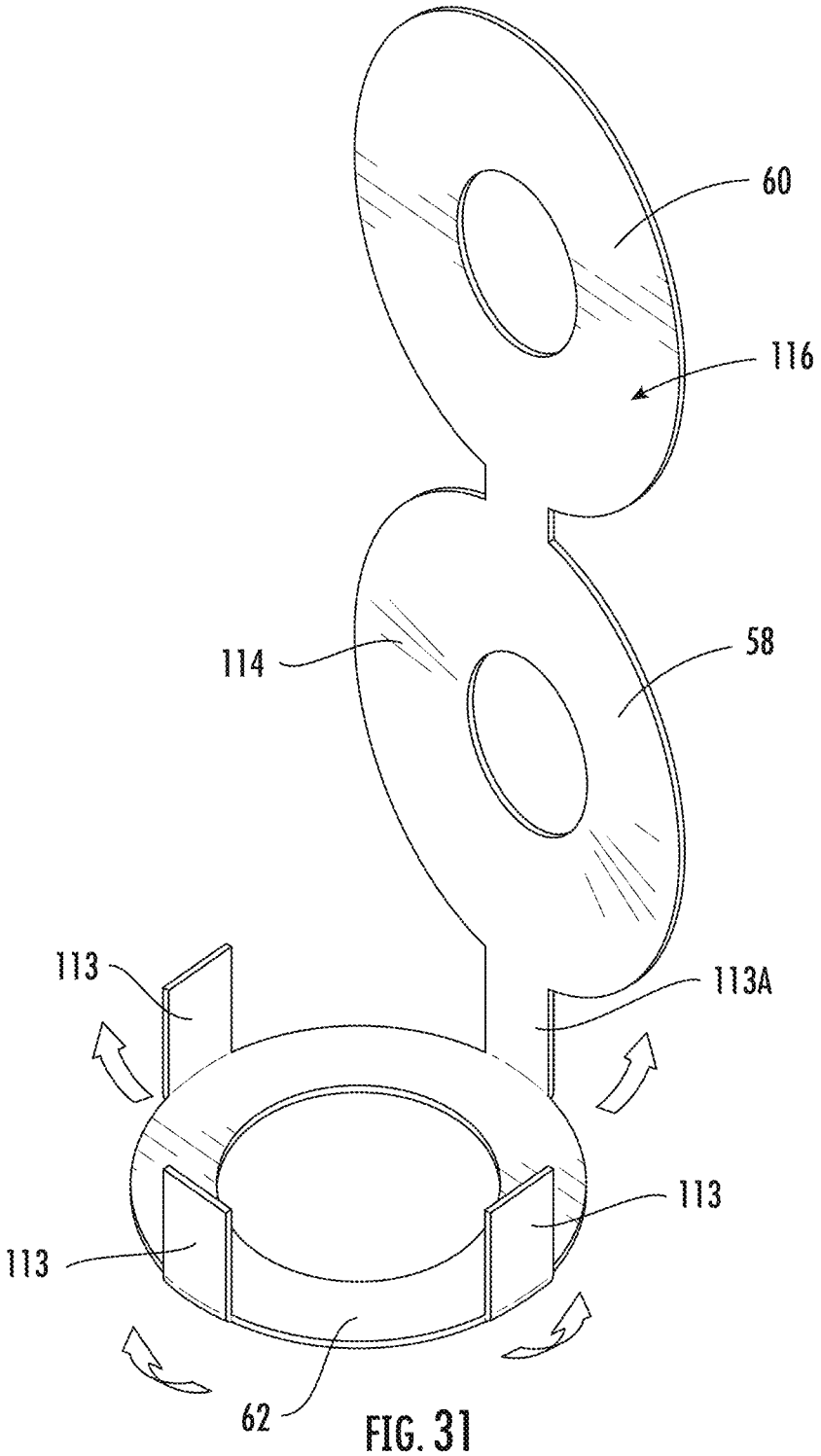
FIG. 31 is a perspective view showing the first steps of bending the metal to form an energy guidance device of the present disclosure.
Figure 32:
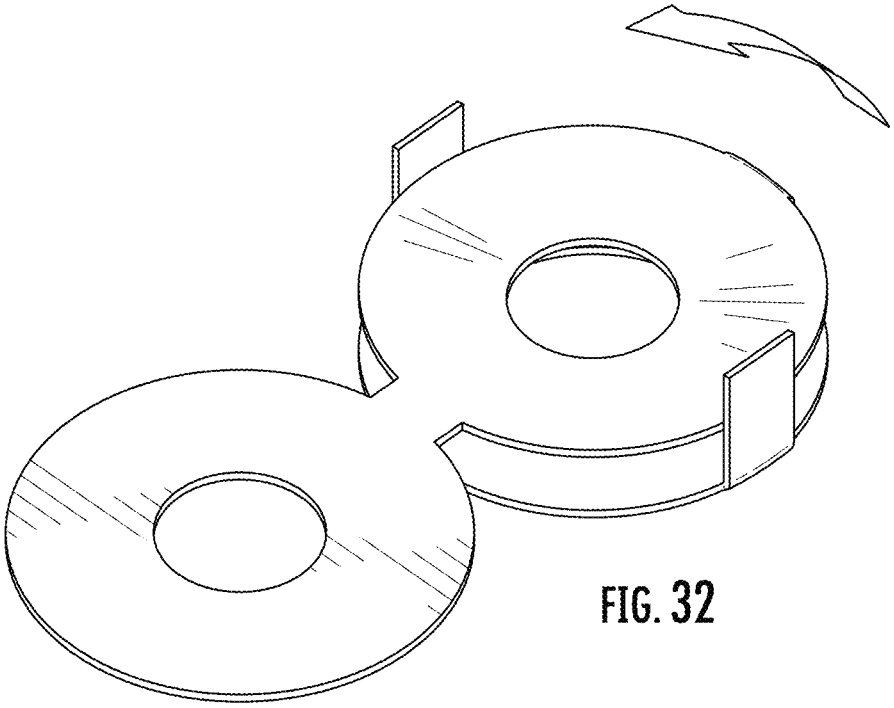
FIG. 32 shows and further intermediate step in the bending of the metal to form an energy guidance device of the present disclosure.
Figure 33:
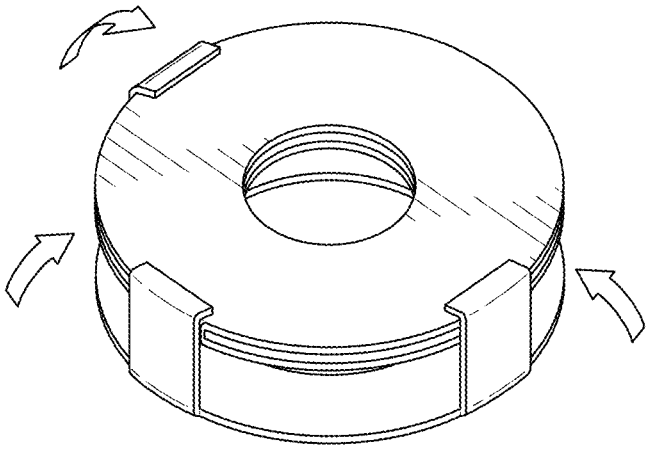
FIG. 33 show a further next step of the bending of the metal material to form a final energy guidance device according to an aspect of the present disclosure.
Figure 34:
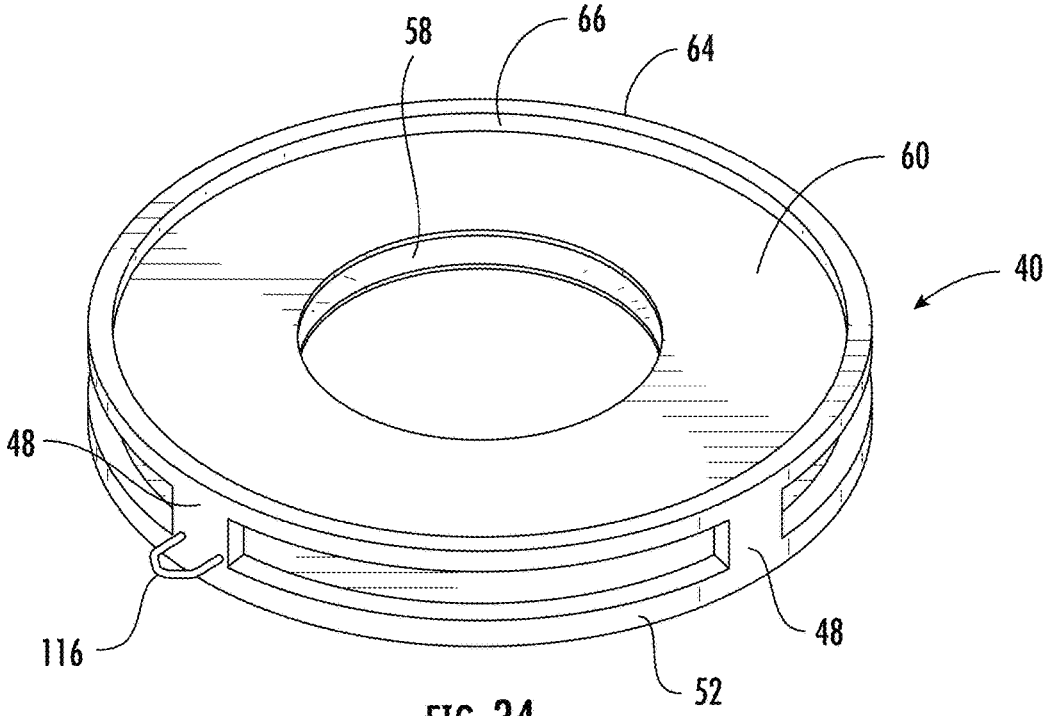
FIG. 34 shows a front perspective view of an energy guidance device of the present disclosure having at least two opposing loops or other grappling surface to allow for a user to use lifting rods to engage the loops and lift the energy guidance device from engagement with the top of the smokeless fire pit.
Figure 35:
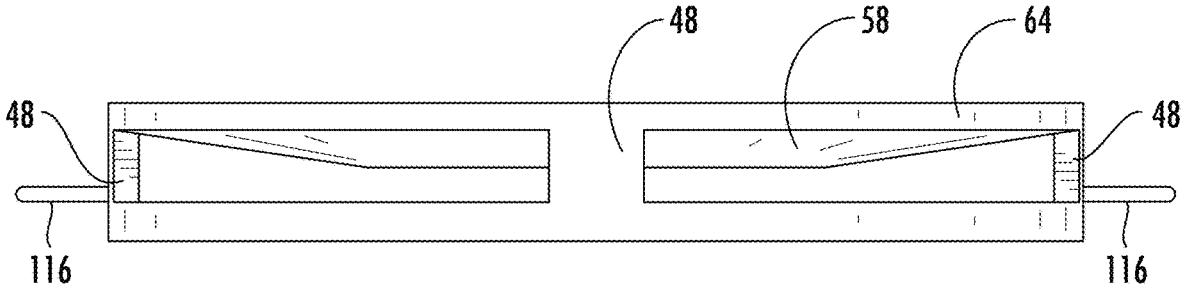
FIG. 35 is an elevated front view of the energy guidance device of FIG. 34.
Figure 36:
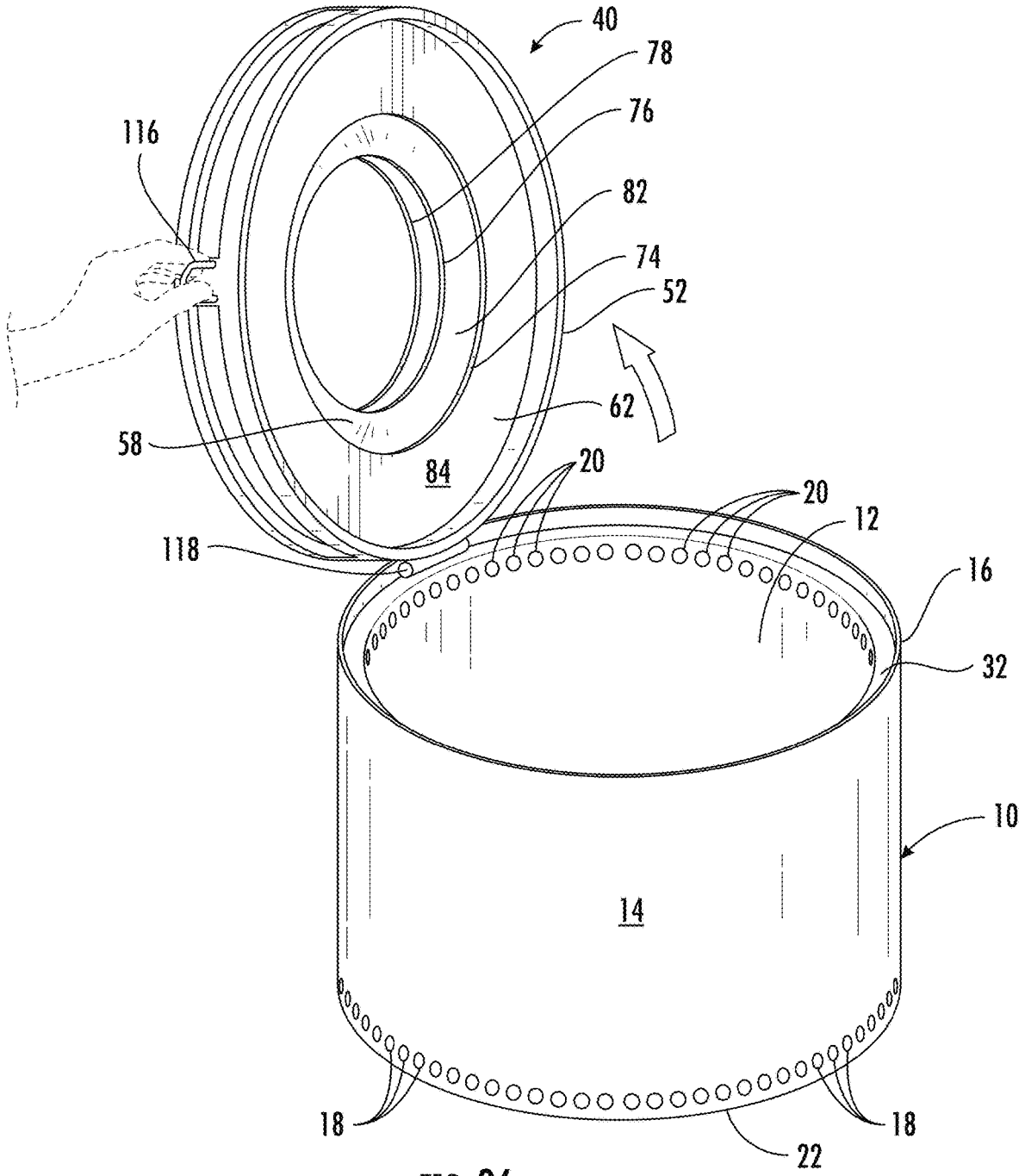
FIG. 36 is a perspective view of an alternative embodiment of the present disclosure showing the energy guidance device hingedly engaged to the top of the smokeless fire pit and being opened using the user's hand, but can be opened with a rod or other heat protective device.
Figure 37:
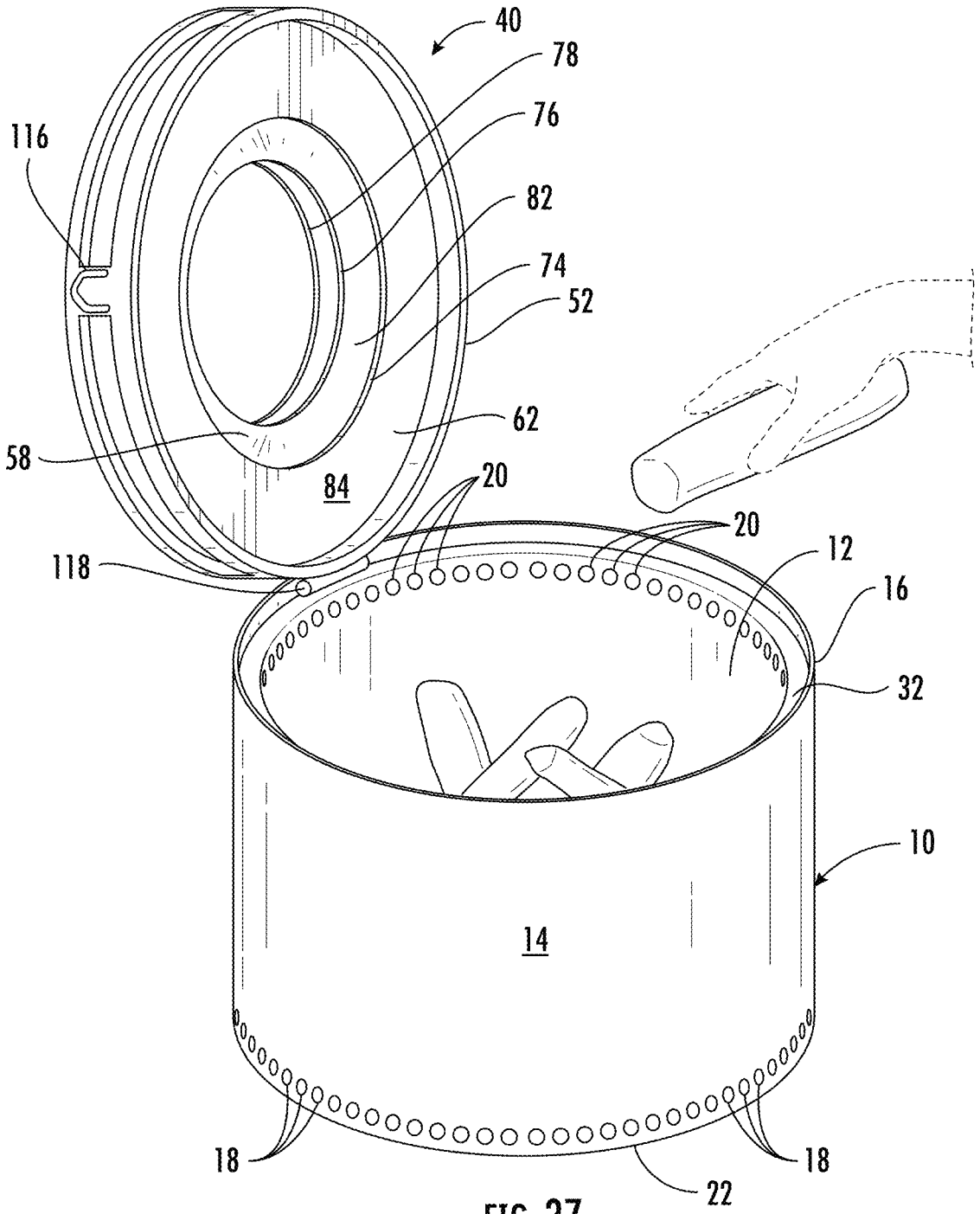
FIG. 37 is a perspective view of a person loading the interior of the smokeless fire pit with fuel/wood with the energy guidance device in the lifted/open position.
Figure 38:
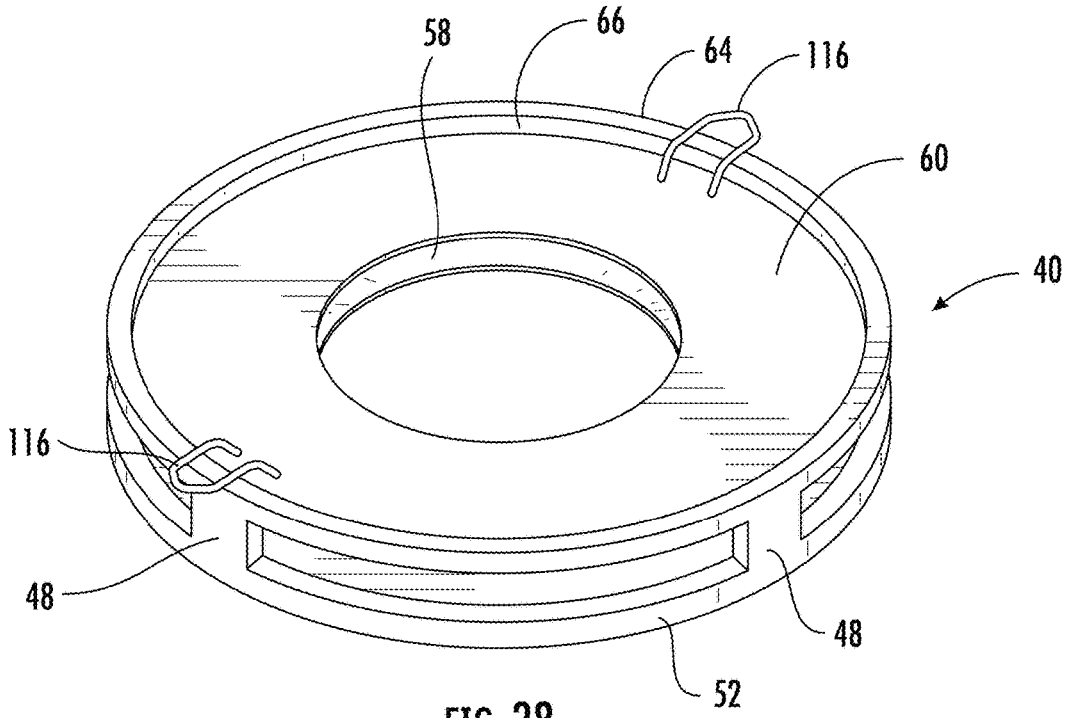
FIG. 38 is an upper left perspective view showing an energy guidance device of the present disclosure with bent lifting rod engagement loops engaged with a top surface of the energy guidance device where the engagement location can be the top rim portion or further inside the rim of the top surface.
Figure 39:
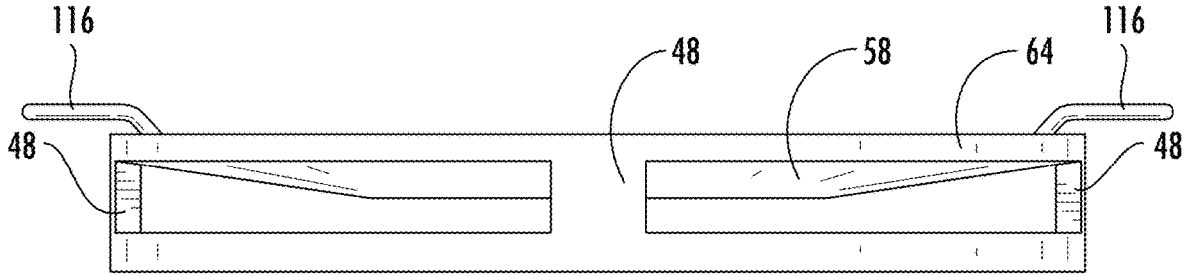
FIG. 39 is an elevated front view of the energy guidance device shown in FIG. 38.

FIG. 31 shows a first stage in the bending process where the rectangular-shaped sections are bent. Next, as shown in FIG. 32 the at least partially angled deflecting surface is bent over to also form a shorter support 48. A similar shorter support 48 is formed in the opposite side when the flat top generally planar surface is formed. A larger support 113 is bent up and overlaps this shorter support segment and can be welded or held in position via one or both of an engagement on the vertical upright portion where there is overlapping and/or on the bent over top portion of the standard sized segment and the top generally planar surface. This is shown in FIG. 33. The connection points may be jointed with one another using a weld most typically, but could be joined using any method or fastener that can durably withstand and maintain the engagement of the components at elevated temperatures found in a smokeless fire pit, typically at least about 1000 degrees Fahrenheit.

Figure 40:
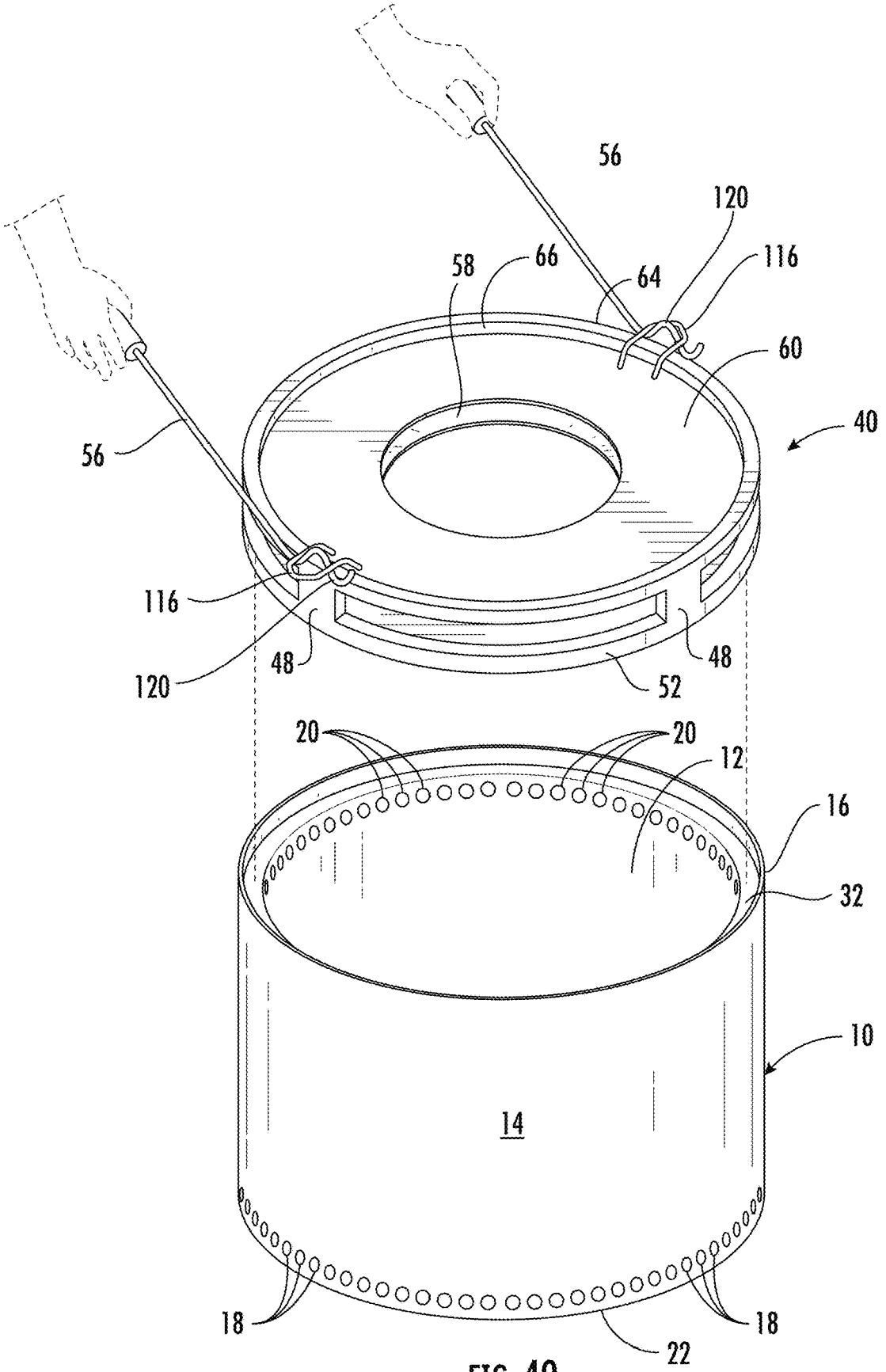
FIG. 40 shows a perspective view where a user is using lifting rods to lift or set the energy guidance device into and out of engagement with the top portion of the fire pit.

As shown in FIGS. 34-40 the energy guidance device 40 may also have one or a plurality of device handles 116 that may be handled by the human when the temperature is not elevated such that handling the device handle 116 would cause harm to the human. The device handles also typically have a center aperture formed by bending a metal rod and the metal rod has engaging ends that engage the energy guidance device on its side(s) or top to form a loop. As shown in FIG. 40, a human can use one or two lifting rods 56 to lift and remove or place the energy guidance device 40 into engagement with the smokeless fire pit 10. The lifting rods typically have a rod handle 118 on one end and a distal energy guidance device engaging end 120 that is typically generally W-shaped to allow for more stable engagement with the handle 116 in the configuration shown in FIG. 40.

Figure 41:
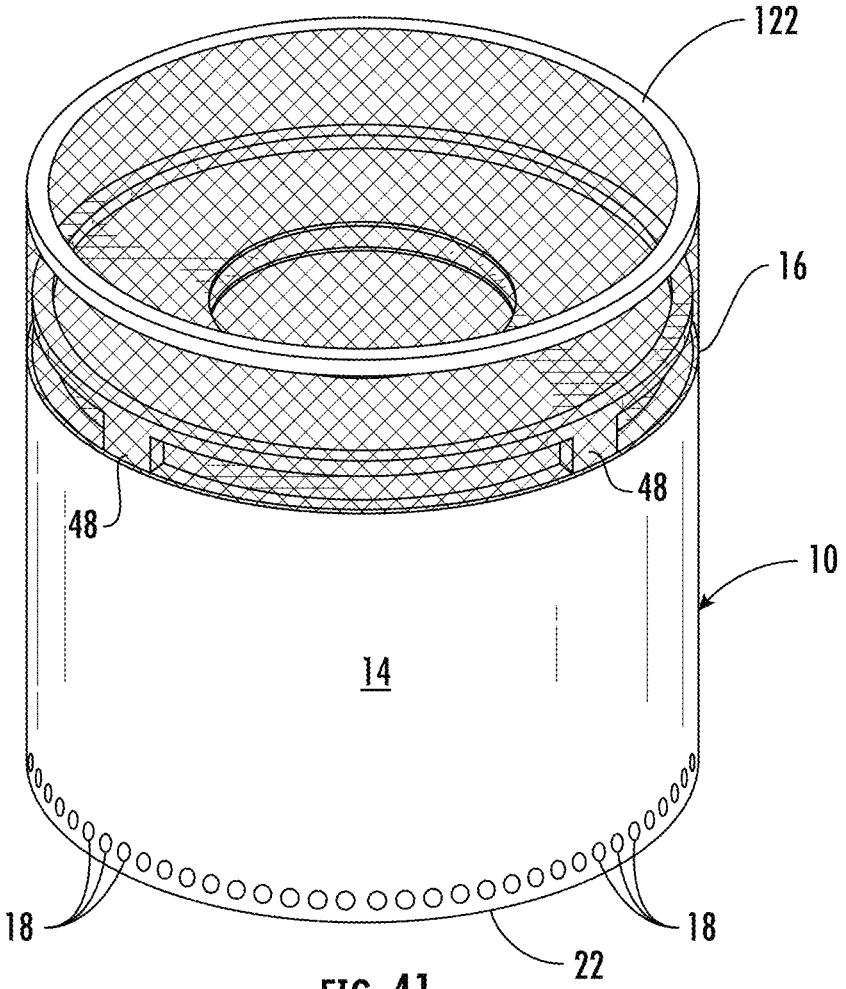
FIG. 41 shows a metal mesh shield placed over the top and sides of the energy guidance device and typically into engagement with the top perimeter rim of the smokeless fire pit to prevent or limit hot embers from leaving the interior of the fire pit.

As shown in FIG. 41, the energy guidance device 40 may be covered with a metal mesh screen cover 122 that is typically cylindrically-shaped to help prevent hot embers from leaving the confined interior of the smokeless fire pit. As shown in FIG. 41, the cylindrically-shaped metal mesh screen cover 122 is taller in cylindrical height than the height of the energy guidance device, but can be sized such that the top of the cover 122 is spaced immediately adjacent to top of the energy guidance device 40.

Figure 42:
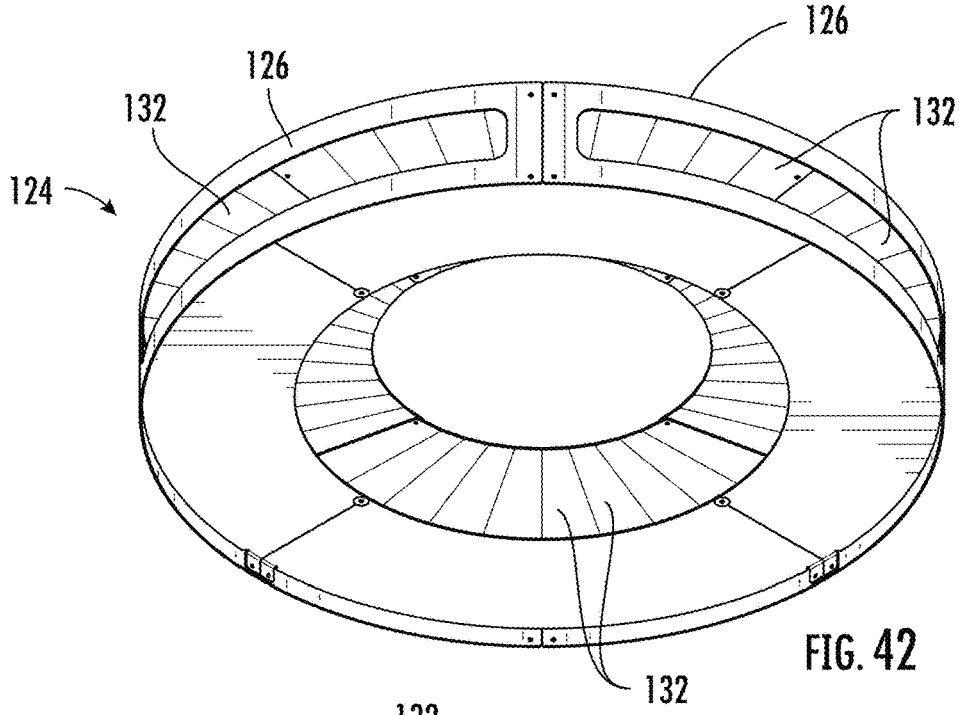
FIG. 42 is a bottom perspective view of an energy guidance device according to another aspect of the present disclosure where three separate sections are connected with fasteners such as screws and utilize individually cut panels to form the conical portion.
Figure 43:
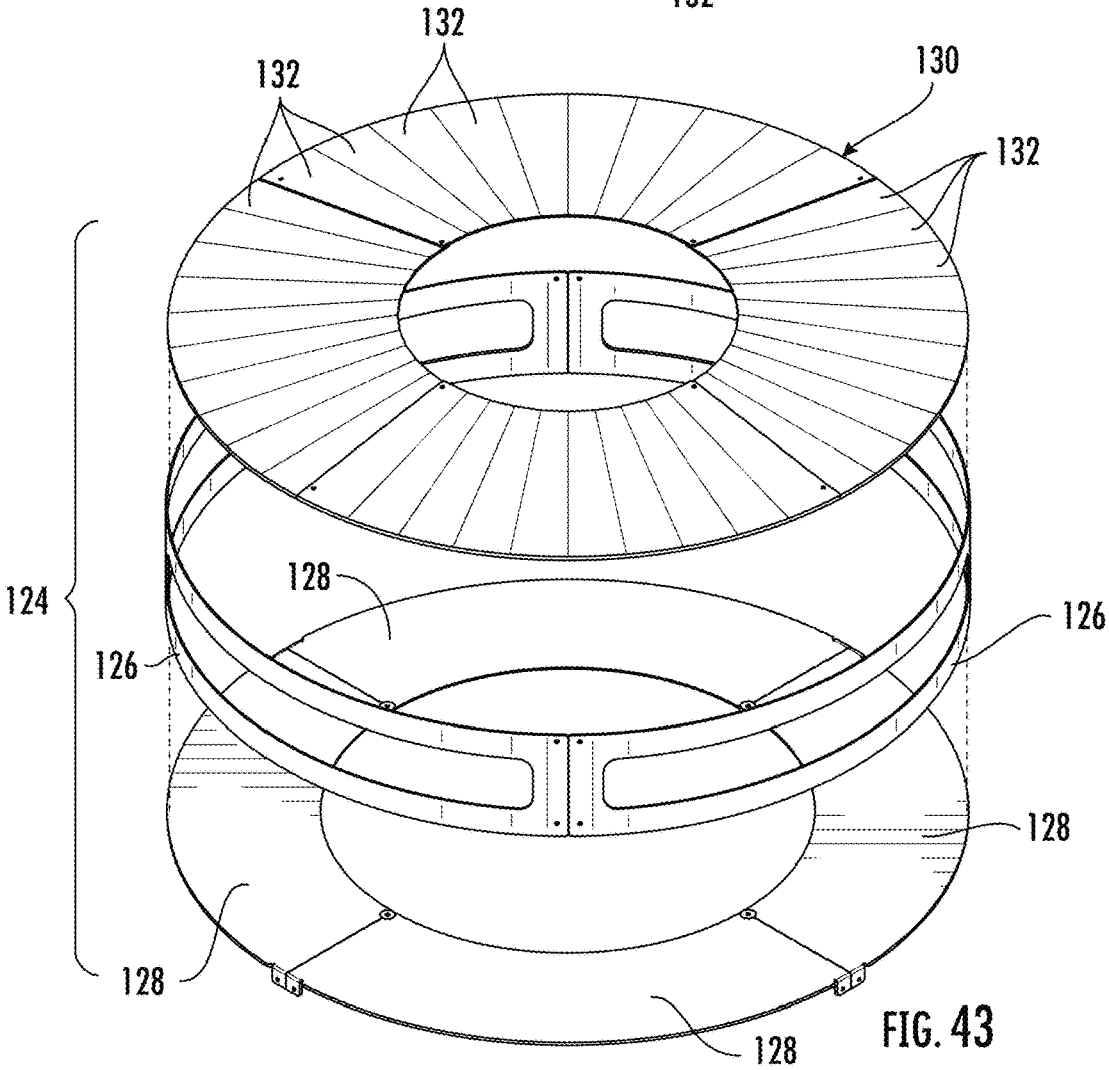
FIG. 43 shows an exploded view of the three components mentioned in FIG. 42 partially assembled.
Figure 44:
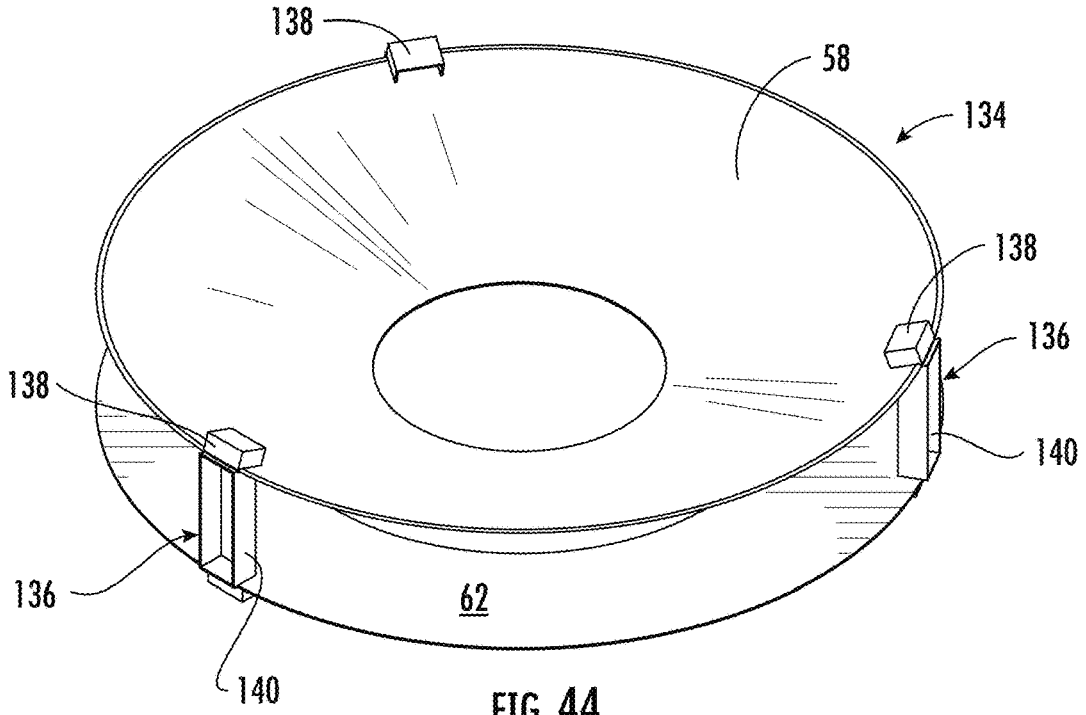
FIG. 44 is an energy guidance device according to the present disclosure optionally connected together without any welding or traditional fasters.
Figure 45:
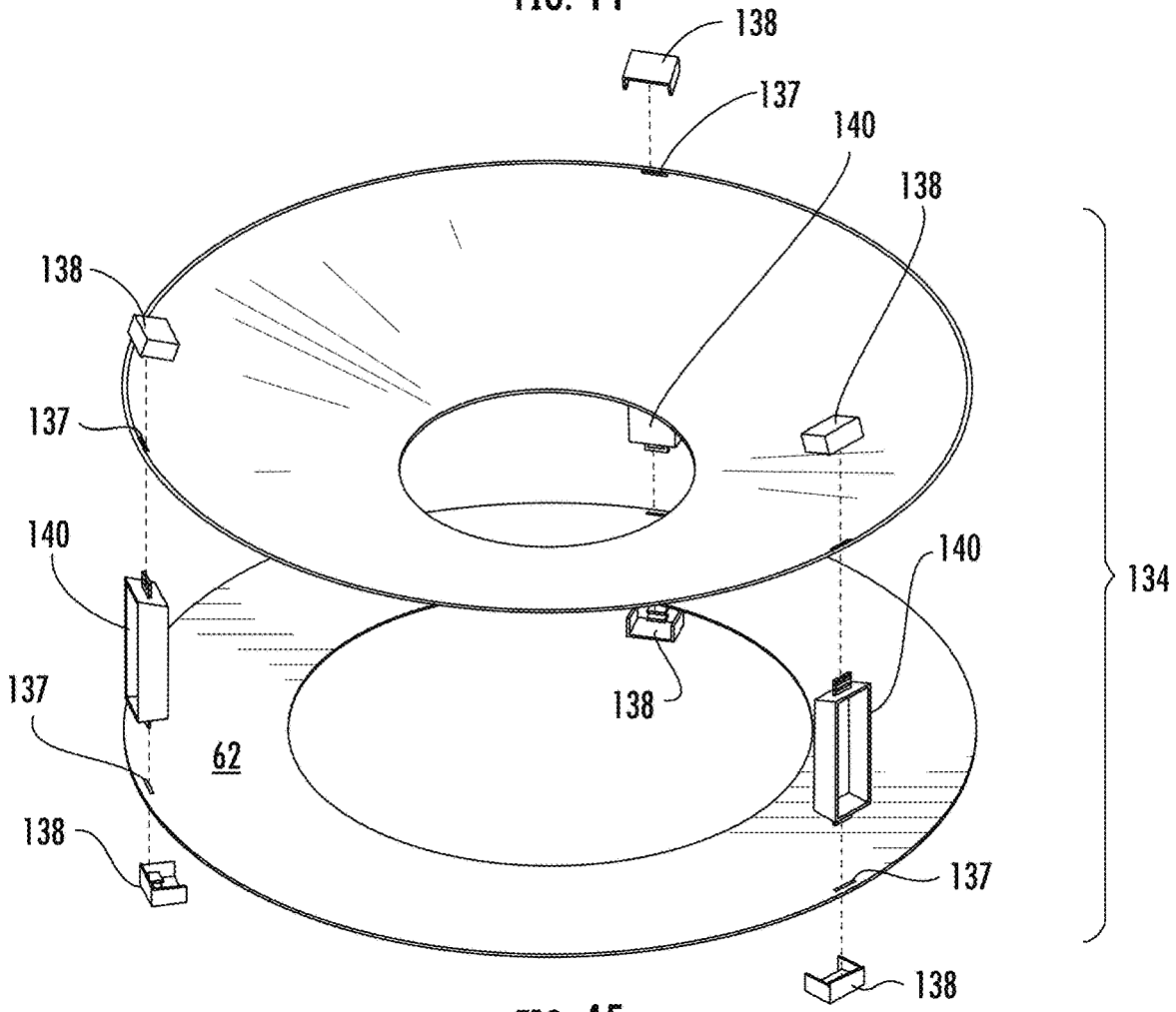
FIG. 45 is an exploded view of the energy guidance device shown in FIG. 44 with the pins on the top and bottom to frictionally engaged the pins in position and support the angled plate above the bottom plate and in engagement with both.
Figure 46:
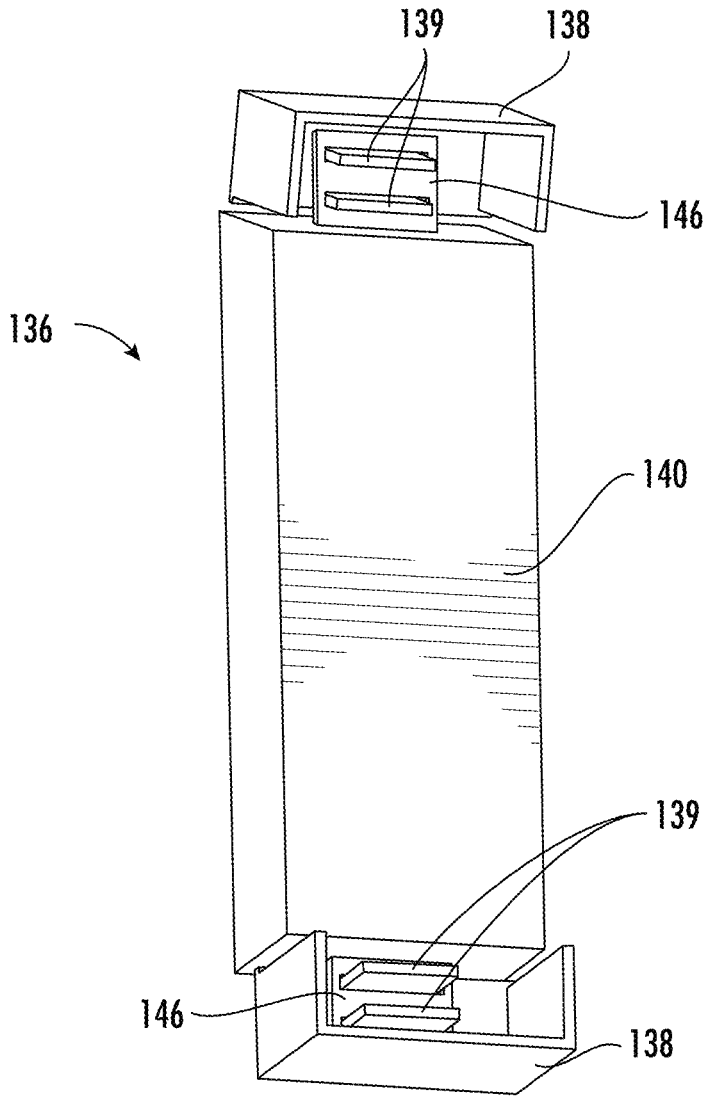
FIG. 46 is a perspective view of the pin assembly with the top pin and the bottom pin engaged with the center stand and showing the gaps where the top/angled plate and the bottom plate are positioned to be frictionally engaged.

As shown in FIGS. 42-43 the energy guidance device 40 may be an assembly 124 formed using fasteners. The assembly 124 may made from a combination of various components connected using a plurality of fasteners such as sheet metal screws or self-tapping metal screws and a series smaller generally trapezoidal shaped segments 132 that can be cut or stamped and thereafter welded together to form the at least partially angled deflecting surface 58. The at least partially angled deflective surface formed from the plurality of segments 132 is shown as component 130 in FIGS. 42-43. The side portions 126 form the gap between the bottom support formed by, in the case shown, four identical stamped or otherwise formed metal sections 128. The formed metal sections 128 can be affixed to one another using fasteners as well such as sheet metal screws or similar fasteners.

Figure 47:
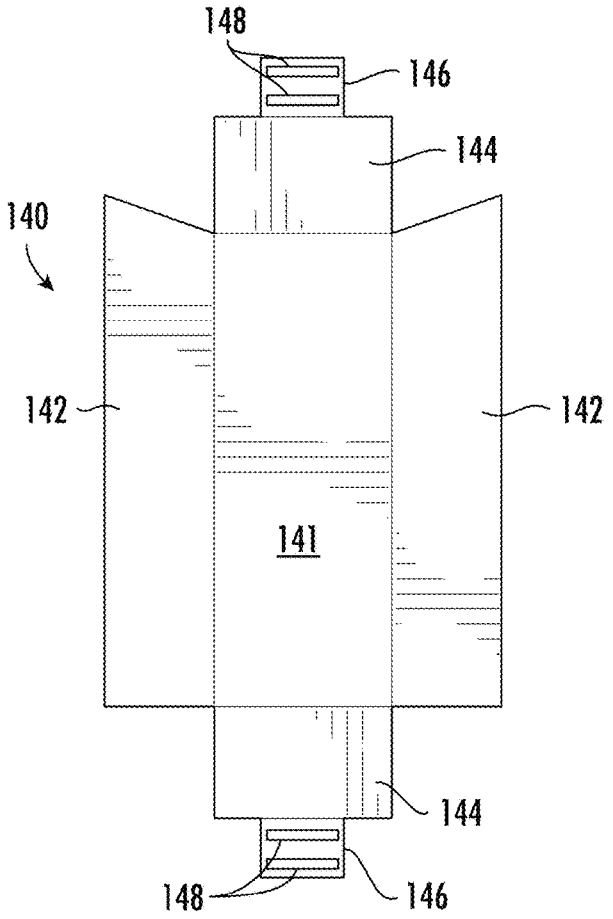
FIG. 47 is a perspective view showing a cut flat metal material used to create the center stand shown in FIGS. 44-46.
Figure 48:
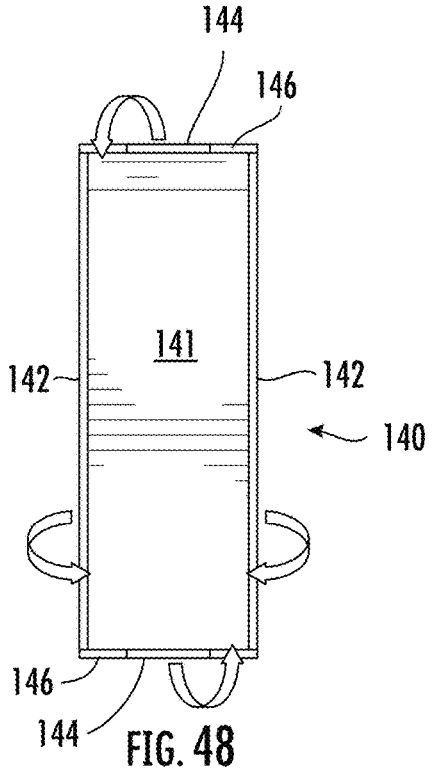
FIG. 48 is a perspective view showing the initial formation stage where the metal is bent at the sides and bottom of the previously flat cut metal material.
Figure 49:
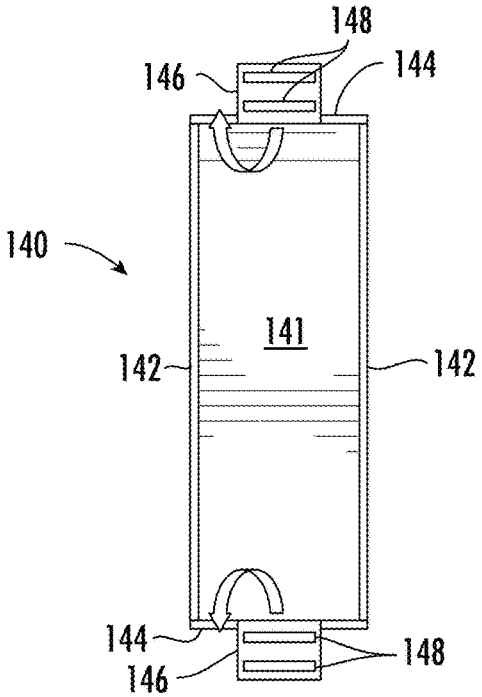
FIG. 49 is perspective view showing the next stage of the formation of the center stand by bending the end tabs upwards and downward (depending on the end of the pin) to show the grooved apertures at each end that receive projections from the top and bottom pins to form the overall assembly.

In a further aspect of the present disclosure shown in FIGS. 44-49, the energy guidance device may have a plurality, more typically all, of the components frictionally held in engagement with one another such that fasteners and/or welding is not necessary and can be omitted from use. The device of FIGS. 44-49 shows the at least partially angled deflecting surface 58 combined with a series of leg assemblies 136 and a bottom support 62 form the frictionally retained assembly 134, which in this aspect of the present disclosure is an energy guidance device. The at least partially angled deflecting surface 58 and the bottom support 62 are sandwiched between the stand 140 and the pins 138 of the leg assemblies 136 in the space therebetween to frictionally hold the overall frictionally retained assembly 134. The pins typically have a plurality of extension pins 139 that are positioned within the correspondingly shaped grooves 148 in the tabs 146. The tabs 146 extend through slits 137 in the at least partially angled deflecting surface 58 and the bottom support 62. The slits 137 are typically proximate the outer perimeter edge of both the at least partially angled deflecting surface 58 and the bottom support 62 and are typically evenly spaced circumferentially about both and in a number corresponding to the number of leg assemblies to be employed, which is typically at least three leg assemblies, but may be four, five, six or more leg assemblies as desired. The stand 140 may be constructed by folding the various metal segments of the stand as shown in FIGS. 47-49. The stand 140 typically has the side sections 142 folded inwardly to form the c-shaped main body 141. The top and bottom portions 144 of the stand 140 are typically bent toward one another to create the top and bottom of the overall stand 140 and then the tabs 146 are bent outwardly so that they extend upward from a side of the top and bottom portions 144. This exposes the extension pin receiving slots/apertures 148. The extension pin receiving slots/apertures are the female portion of the engagement and the extension pins are the male of this configuration.

What is claimed is:

1. An energy guidance/heat deflecting device for redirecting convective and radiant energy leaving from an interior volume of a smokeless fire pit out an open top of the smokeless fire pit comprising:

a circular, planar bottom support having an exterior perimeter edge, an interior circular aperture defined by a bottom support interior circular aperture perimeter edge, a smokeless fire pit facing side, an exterior perimeter portion proximate the exterior perimeter edge, and an upward facing side;

at least three upwardly extending supports each spaced from one another and spaced about the exterior perimeter portion of the circular, planar bottom support and proximate the exterior perimeter edge of the circular, planar bottom support and wherein the at least three upwardly extending supports each have a bottom support engaging end portion and an opposite end portion, which is a downwardly facing truncated cone shaped energy deflecting material engaging end portion;

a downwardly facing truncated cone shaped energy deflecting material having a smokeless fire pit facing surface, an upwardly facing surface, and a downwardly facing aperture defined by a perimeter edge of a first end of the downwardly facing truncated cone shaped energy deflecting material and an upwardly facing perimeter, wherein a diameter of the downwardly facing aperture is smaller than the diameter of the upwardly facing perimeter, and wherein the upwardly facing perimeter of the downwardly facing truncated cone shaped energy deflecting material engages the downwardly facing truncated cone shaped energy deflecting material engaging end portion of each of the at least three upwardly extending supports such that the downwardly facing aperture is spaced above the interior circular aperture defined by the bottom support interior circular aperture perimeter edge; and wherein the diameter of the interior circular aperture defined by the bottom support interior circular aperture perimeter edge is larger than the diameter of the downwardly facing aperture of the downwardly facing truncated cone shaped energy deflecting material such that convective and radiant heat energy leaving the smokeless fire pit will contact a portion of the smokeless fire pit facing surface and be directed outwardly and sideways away from the smokeless fire pit when the smokeless fire pit is in use and the energy guidance/heat deflecting device is engaged with the top of the smokeless fire pit.

2. The energy guidance/heat deflecting device of claim 1, wherein the diameter of the upwardly facing perimeter of the downwardly facing truncated cone shaped energy deflecting material is at least within one half inch of the diameter of the exterior perimeter edge of the circular, planar bottom support.

3. The energy guidance/heat deflecting device of claim 2, wherein the diameter of the upwardly facing perimeter of the downwardly facing truncated cone shaped energy deflecting material is the same as the diameter of the exterior perimeter edge of the circular, planar bottom support.

4. The energy guidance/heat deflecting device of claim 3, wherein the at least three upwardly extending supports are integrated into a circumferential side wall extending around an entirety of the energy guidance/heat deflecting device, wherein the circumferential side wall creates an upwardly facing, top perimeter rim that extends beyond the upwardly facing perimeter of the downwardly facing truncated cone shaped energy deflecting material and there are at least three heat energy delivering windows in the side of the circumferential side wall that allow radiant and convective heat to be delivered therethrough during use of the energy guidance/heat deflecting device.

5. The energy guidance/heat deflecting device of claim 2, wherein the at least three upwardly extending supports are integrated into a circumferential side wall extending around an entirety of the energy guidance/heat deflecting device, wherein the circumferential side wall creates an upwardly facing, a top perimeter rim that extends beyond the upwardly facing perimeter of the downwardly facing truncated cone shaped energy deflecting material.

6. The energy guidance/heat deflecting device of claim 5, wherein the energy guidance/heat deflecting device is free of any legs or other supports extending below the circular, planar bottom support that engage the smokeless fire pit during use.

7. The energy guidance/heat deflecting device of claim 6 further comprising a flat top ring that has a flat top ring center aperture defined by a flat top ring interior edge and a flat top ring center aperture diameter and wherein the flat top ring is engaged to each of the at least three upwardly extending supports at the downwardly facing truncated cone shaped energy deflecting material engaging end portion but above where the downwardly facing truncated cone shaped energy deflecting material is engaged to the downwardly facing truncated cone shaped energy deflecting material engaging end portion.

8. The energy guidance/heat deflecting device of claim 7, wherein the flat top ring center aperture diameter is within one inch of the diameter of the diameter of the upwardly facing perimeter of the downwardly facing truncated cone shaped energy deflecting material.

9. The energy guidance/heat deflecting device of claim 1, wherein each of the circular, planar bottom support and the downwardly facing truncated cone shaped energy deflecting material have a thickness of about one tenth of an inch or less and are capable of being heated above 1000 degrees Fahrenheit without changing their physical structural shaped or material characteristics.

10. The energy guidance/heat deflecting device of claim 1, wherein each of the circular, planar bottom support and the downwardly facing truncated cone shaped energy deflecting material are 16 gauge polished stainless steel.

11. The energy guidance/heat deflecting device of claim 10, wherein the at least three upwardly extending supports are each constructed of 16 gauge polished stainless steel.

12. The energy guidance/heat deflecting device of claim 10, wherein the downwardly facing aperture is concentrically aligned above the interior circular aperture defined by the bottom support interior circular aperture perimeter edge.

13. The energy guidance/heat deflecting device of claim 10, wherein the downwardly facing aperture is concentrically aligned above the interior circular aperture defined by the bottom support interior circular aperture perimeter edge.

14. The energy guidance/heat deflecting device of claim 13, wherein the circular, planar bottom support and the downwardly facing truncated cone shaped energy deflecting material are each fixed to the at least three upwardly extending supports by a weld; the downwardly facing aperture is concentrically aligned above the interior circular aperture defined by the bottom support interior circular aperture perimeter edge; and the at least three upwardly extending supports are rectangular shaped 16 gauge stainless steel.

15. The energy guidance/heat deflecting device of claim 1 integrally formed into a top portion of the smokeless fire pit wherein the smokeless fire pit has air inlets circumferentially located around the exterior of a base, an air channel within a side wall of the smokeless fire pit and heated air outlets circumferentially spaced around an interior, fire facing side surface of the top portion of the smokeless fire pit and wherein the energy guidance/heat deflecting device is positioned so that the circular, planar bottom support is spaced above a plane defined by the heated air outlets.

16. The energy guidance/heat deflecting device of claim 1 integrally formed into a top portion of the smokeless fire pit wherein the smokeless fire pit has air inlets circumferentially located around the exterior of a base, an air channel within a side wall of the smokeless fire pit and heated air outlets circumferentially spaced around an interior, fire facing side surface of the top portion of the smokeless fire pit and wherein the energy guidance/heat deflecting device is positioned so that the circular, planar bottom support is spaced above a plane defined by the heated air outlets.

17. The energy guidance/heat deflecting device of claim 1, wherein the at least three upwardly extending supports each (1) frictionally engage and retain the circular, planar bottom support within a first gap of each of the at least three upwardly extending supports wherein the first gap is between a central stand and a first pin positioned on the smokeless fire pit facing side and the first pin engages at least one hole in a bottom tab of the central stand that extends through the circular, planar bottom support; and (2) frictionally engage and retain the downwardly facing truncated cone shaped energy deflecting material within a second gap of each of the at least three upwardly extending supports wherein the second gap is between the central stand and a second pin positioned on the upwardly facing surface of the downwardly facing truncated cone shaped energy deflecting material and the second pin engages at least one hole in a top tab of the central stand that extends through the downwardly facing truncated cone shaped energy deflecting material; and wherein all components of the energy guidance/heat deflecting device are constructed of 16 gauge stainless steel.

18. An energy guidance/heat deflecting device for redirecting convective and radiant energy leaving from an interior volume of a smokeless fire pit out the open top of the smokeless fire pit comprising:

a circular, planar bottom support having an exterior perimeter edge, an interior circular aperture defined by a bottom support interior circular aperture perimeter edge, a smokeless fire pit facing side, an exterior perimeter portion proximate the exterior perimeter edge, and an upward facing side;

at least three upwardly extending supports each spaced from one another and spaced about the exterior perimeter portion of the circular, planar bottom support and proximate the exterior perimeter edge of the circular, planar bottom support and wherein the at least three upwardly extending supports each have a bottom support engaging end portion and an opposite end portion, which is a downwardly facing truncated cone shaped energy deflecting material engaging end portion;

a downwardly facing truncated cone shaped energy deflecting material having smokeless fire pit facing surface, an upwardly facing surface, and a downwardly facing aperture defined by a perimeter edge of a first end of the downwardly facing truncated cone shaped energy deflecting material and an upwardly facing perimeter, wherein a diameter of the downwardly facing aperture is smaller than the diameter of the upwardly facing perimeter, and wherein the upwardly facing perimeter of the downwardly facing truncated cone shaped energy deflecting material engages the downwardly facing truncated cone shaped energy deflecting material engaging end portion of each of the at least three upwardly extending supports such that the downwardly facing aperture is spaced above the interior circular aperture defined by the bottom support interior circular aperture perimeter edge;

wherein the diameter of the interior circular aperture defined by the bottom support interior circular aperture perimeter edge is larger than the diameter of the downwardly facing aperture of the downwardly facing truncated cone shaped energy deflecting material such that convective and radiant heat energy leaving the smokeless fire pit will contact a portion of the smokeless fire pit facing surface and be directed outwardly and sideways away from the smokeless fire pit when the smokeless fire pit is in use and the energy guidance/heat deflecting device is engaged with the top of the smokeless fire pit;

a flat top ring that has a flat top ring center aperture defined by a flat top ring interior edge and a flat top ring center aperture diameter and wherein the flat top ring is engaged to each of the at least three upwardly extending supports at the downwardly facing truncated cone shaped energy deflecting material engaging end portion but above where the downwardly facing truncated cone shaped energy deflecting material is engaged to the downwardly facing truncated cone shaped energy deflecting material engaging end portion;

wherein the circular, planar bottom support and the downwardly facing truncated cone shaped energy deflecting material are each fixed to the at least three upwardly extending supports by a weld; the downwardly facing aperture is concentrically aligned above the interior circular aperture defined by the bottom support interior circular aperture perimeter edge; and wherein each of the circular, planar bottom support, the at least three upwardly extending supports, and the downwardly facing truncated cone shaped energy deflecting material are 16 gauge polished stainless steel.

19. An energy guidance/heat deflecting device for redirecting convective and radiant energy leaving from an interior volume of a smokeless fire pit out the open top of the smokeless fire pit comprising:

a circular, planar bottom support having an exterior perimeter edge, an interior circular aperture defined by a bottom support interior circular aperture perimeter edge, a smokeless fire pit facing side, an exterior perimeter portion proximate the exterior perimeter edge, and an upward facing side;

at least three upwardly extending supports each spaced from one another and spaced about the exterior perimeter portion of the circular, planar bottom support and proximate the exterior perimeter edge of the circular, planar bottom support and wherein the at least three upwardly extending supports each have a bottom support engaging end portion and an opposite end portion, which is a downwardly facing truncated cone shaped energy deflecting material engaging end portion;

a downwardly facing truncated cone shaped energy deflecting material having smokeless fire pit facing surface, an upwardly facing surface, and a downwardly facing aperture defined by a perimeter edge of a first end of the downwardly facing truncated cone shaped energy deflecting material and an upwardly facing perimeter, wherein a diameter of the downwardly facing aperture is smaller than the diameter of the upwardly facing perimeter, and wherein the upwardly facing perimeter of the downwardly facing truncated cone shaped energy deflecting material engages the downwardly facing truncated cone shaped energy deflecting material engaging end portion of each of the at least three upwardly extending supports such that the downwardly facing aperture is spaced above the interior circular aperture defined by the bottom support interior circular aperture perimeter edge;

wherein the diameter of the interior circular aperture defined by the bottom support interior circular aperture perimeter edge is larger than the diameter of the downwardly facing aperture of the downwardly facing truncated cone shaped energy deflecting material such that convective and radiant heat energy leaving the smokeless fire pit will contact a portion of the smokeless fire pit facing surface and be directed outwardly and sideways away from the smokeless fire pit when the smokeless fire pit is in use and the energy guidance/heat deflecting device is engaged with the top of the smokeless fire pit;

wherein the circular, planar bottom support and the downwardly facing truncated cone shaped energy deflecting material are each fixed to the at least three upwardly extending supports by a weld; the downwardly facing aperture is concentrically aligned above the interior circular aperture defined by the bottom support interior circular aperture perimeter edge; and wherein a flat top ring center aperture diameter is within one inch of the diameter of the diameter of the upwardly facing perimeter of the downwardly facing truncated cone shaped energy deflecting material; and wherein each of the circular, planar bottom support, the at least three upwardly extending supports, and the downwardly facing truncated cone shaped energy deflecting material are 16 gauge polished stainless steel.

20. The energy guidance/heat deflecting device of claim 19, wherein the energy guidance/heat deflecting device is free of any legs or other supports extending below the circular, planar bottom support that engage the smokeless fire pit during use and no part of the energy guidance/heat deflecting device extends beyond an exterior surface of a side wall of the smokeless fire pit the energy guidance/heat deflecting device is engaged with during use and wherein the energy guidance/heat deflecting device further comprises at least one handle fixedly engaged to an exterior facing surface of the energy guidance/heat deflecting device wherein the at least one handle has a center aperture within the at least one handle.

* * * * *